US008366200B2

(12) United States Patent
Schwartz

(10) Patent No.: US 8,366,200 B2
(45) Date of Patent: Feb. 5, 2013

(54) FURNITURE ASSEMBLY

(75) Inventor: Larry Schwartz, Boca Raton, FL (US)

(73) Assignee: Casual Living Worldwide, Inc., Louisville, KY (US)

( * ) Notice: Subject to any disclaimer, the term of this patent is extended or adjusted under 35 U.S.C. 154(b) by 0 days.

(21) Appl. No.: 12/824,729

(22) Filed: Jun. 28, 2010

(65) Prior Publication Data

US 2010/0259080 A1 Oct. 14, 2010

Related U.S. Application Data

(63) Continuation of application No. 11/643,031, filed on Dec. 19, 2008, now Pat. No. 7,758,128.

(60) Provisional application No. 60/751,599, filed on Dec. 19, 2005.

(51) Int. Cl.
*A47C 7/00* (2006.01)
*A47C 3/04* (2006.01)

(52) U.S. Cl. ..... 297/440.22; 297/440.14; 297/440.1; 297/239

(58) Field of Classification Search ..... 297/440.1, 297/440.14, 440.18, 440.22, 239; 206/326; 108/91
See application file for complete search history.

(56) References Cited

U.S. PATENT DOCUMENTS

| | | | | | |
|---|---|---|---|---|---|
| 1,660,119 | A | * | 2/1928 | Decker | 446/69 |
| 2,055,340 | A | | 9/1936 | Dellert | |
| 2,642,119 | A | | 6/1953 | Dary | |
| 2,667,211 | A | | 1/1954 | Krasanov | |
| 2,961,037 | A | * | 11/1960 | Keefer | 297/440.15 |
| 2,989,343 | A | | 6/1961 | Loesch | |
| 3,057,661 | A | * | 10/1962 | Moxley | 297/451.1 |
| 3,451,718 | A | | 6/1969 | Kaufman | |
| 3,479,083 | A | | 11/1969 | Lafer | |
| 3,536,356 | A | | 10/1970 | Wilson | |
| 3,600,036 | A | * | 8/1971 | Iskander | 297/239 |
| 3,817,573 | A | * | 6/1974 | Facury | 297/125 |
| 4,050,736 | A | * | 9/1977 | Karp | 297/135 |
| 4,254,992 | A | | 3/1981 | Orosa et al. | |
| 5,338,095 | A | * | 8/1994 | Laughlin et al. | 297/440.1 |
| 5,803,540 | A | | 9/1998 | Schwartz | |
| 5,813,722 | A | | 9/1998 | Smith et al. | |
| 6,179,382 | B1 | | 1/2001 | Schwartz | |
| 7,744,162 | B2 | | 6/2010 | Griggs, Jr. | |
| 7,758,128 | B2 | | 7/2010 | Schwartz | |
| 2006/0033367 | A1 | | 2/2006 | Sweeney | |
| 2010/0259080 | A1 | | 10/2010 | Schwartz | |

OTHER PUBLICATIONS

Office Action from Canadian Application No. 2633342, dated Jul. 14, 2011.

* cited by examiner

*Primary Examiner* — David Dunn
*Assistant Examiner* — Tania Abraham
(74) *Attorney, Agent, or Firm* — Lerner, David, Littenberg, Krumholz & Mentlik, LLP

(57) ABSTRACT

A furniture assembly for compact and efficient packaging, the assembly including a sofa having component parts defining a sofa confine, the component parts including a back, a seat, a pair of front legs, a pair of rear legs, and a skirt, wherein the skirt and the seat are removable, at least one chair having component parts defining a chair confine, the component parts including a back, a seat, a pair of front legs, a pair of rear legs, and a skirt, wherein the seat is removable, a coffee table, an end table, an ottoman, and a plurality of cushions and pillows, wherein the furniture assembly is arranged such that the at least one chair, the coffee table, the end table, the ottoman, and the plurality of cushions and pillows are located within the confines of the sofa.

19 Claims, 30 Drawing Sheets

FURNITURE ASSEMBLY

CROSS-REFERENCE TO RELATED APPLICATIONS

This application is a continuation of U.S. patent Ser. No. 11/643,031, filed Dec. 19, 2006, now issued as U.S. Pat. No. 7,758,128, which claims the benefit of the filing date of U.S. Provisional Patent Application No. 60/751,599 filed Dec. 19, 2005, the disclosures of which are hereby incorporated herein by reference.

BACKGROUND OF THE INVENTION

The present invention relates in general to the field of furniture such as couches, loveseats, chairs, coffee tables, end tables, ottomans, and the like. More specifically, the present invention relates to skirted furniture which may be partially disassembled for compact and efficient packaging.

Historically, furniture was manufactured and packaged wholly assembled, where it was then shipped to various retailers or end users in a fully assembled condition. Particularly for end users, this method of delivery was preferred as no assembly was required. However, this method of manufacture has drawbacks in the current marketplace, as shipping of wholly assembled furniture leaves voids in the packaging, which add to the overall shipping cost per unit shipped. Although this method of delivery does remain a viable method, typically it is only utilized for high-end or specialty furniture. A subset of this method is furniture that may be packaged in a predominantly assembled condition, but which may require connection of limited numbers of components.

Today, most mass-produced furniture is manufactured in a manner which permits the furniture to be shipped in an unassembled condition, such that it may be placed compactly in a box for shipping. Often, such boxes are flat. This practice saves on shipping costs by reducing the container voids which would otherwise remain empty when the article of furniture is packed. Furniture produced by this method of manufacture is often referred to as knock-down or "K.D." furniture.

K.D. furniture suffers from at least two major disadvantages over fully or partially assembled furniture. First, the K.D. furniture is typically shipped with its components completely unassembled, resulting in a vast array of component parts. This requires that the end user have the ability and desire to assemble the furniture prior to use. Such tasks are often difficult for end users, and may require the assistance of paid assembly personnel or helpers, adding to the ultimate expense and efforts required by the end user.

In addition, the joints formed between the field-assembled components are often not as strong as joints which are factory assembled. As a result, the furniture may not last as long or be as stable in use. Even if the field-assembled components are as stable as those which may be factory assembled, many end-users have the perception that such joints are less secure.

In the case of skirted furniture, such as chairs and sofas having skirts extending between each of the adjacent legs, it has been the practice to manufacture and sell such furniture with permanently attached skirts. The permanently attached skirts limit the ability to compactly package such furniture, and are undesirable because of the costs associated with shipping such furniture with the resultant large packaging voids.

In order to alleviate this problem, it is known to provide a partially skirted item of furniture. For example, a chair or sofa may be provided with a skirt extending only between the two front legs, without skirts along the sides or back. While eliminating some of the packaging related problems, consumers find such furniture less attractive than their fully skirted counterparts, and the furniture is thus less desirable.

The present invention has arisen to solve the need for fully skirted articles of furniture which are capable of being shipped in a relatively compact manner, but which do not require complete assembly by the end user. The present invention solves this need while also alleviating the concerns, justified or not, that end user assembled components suffer from strength or longevity deficiencies.

SUMMARY OF THE INVENTION

The present invention overcomes the shortcomings of the prior art by providing, in various embodiments, an assembly of separate pieces of furniture that may be compactly and efficiently packaged for transportation while each individual piece of furniture is either mostly or fully assembled. The term mostly assembled with respect to each individual piece of furniture is to be understood as encompassing an article of furniture assembled with substantially all component parts, but which is not fully assembled. In this regard, component parts of each separate piece of furniture may include a back, a seat bottom, one or a pair of arms, one or a pair of front legs, one or a pair of rear legs, and at least one skirt.

In one aspect of the invention, the furniture assembly comprises at least a sofa with at least one skirt on one of its four sides, and at least one chair, also having at least one skirt on one of its four sides, wherein the sofa may include a removable section comprising a seat bottom and front skirt and the at least one chair may include a removable seat bottom. Preferably, the seat bottom and the front skirt of the sofa are removed as a single unit. However, the seat bottom and front skirt may be removed as separate units.

In accordance with further aspects of the present invention, the removable section of the sofa may include only the seat bottom, with the front skirt fixed in place.

In accordance with other aspects of the present invention, the sofa and chair may be accompanied by various other items of furniture, including additional chairs, ottomans, tables, and the like. Cushions and pillows associated with the furniture may also be provided.

In one aspect of the invention, the sofa may include four cushions. Generally, the sofa includes two seat cushions or one elongated seat cushion that may accommodate approximately two to four adult seated persons based upon the size of the seated persons and the relative size of the sofa. Further, the sofa may include two back cushions or one elongated back cushion that may accommodate approximately the backs of two to four adult seated persons based upon the size of the seated persons and the relative size of the sofa. Still further, the cushions may be integral with the seat and/or the back of the sofa or may instead be easily removable. The term integral shall be defined as not easily removable from a component part. For instance, an integral cushion may be sewn or stapled to the perimeter of a component part, such as the seat. In the case of a seat bottom with integral cushion, removing the single unit, as defined herein, shall be understood as removing the seat bottom, cushion, and front skirt as a single unit, as the cushion would in this case be integral with the seat bottom.

In another aspect of the invention, the at least one chair may include a cushion to accommodate a seated person. The at least one chair may further include a pillow resting on the cushion of the seat. Preferably, the pillow is a throw pillow.

In another aspect of the invention, the sofa may include a plurality of pillows resting on the cushion or cushions of the seat. Preferably, the pillows are throw pillows.

In one aspect of the invention, a furniture assembly may comprise a sofa having a back, a seat, a pair of front legs, a pair of rear legs, and a skirt, wherein the skirt and the seat are removable. The furniture assembly may also comprise at least one chair having a back, a seat, a pair of front legs, a pair of rear legs, and a skirt, wherein the seat of the chair is removable. Further, the furniture assembly may include a coffee table, an end table, an ottoman, and a plurality of cushions and pillows. Preferably, the furniture assembly is arranged such that substantially all of the at least one chair, the coffee table, the end table, and the ottoman are within the confines of the sofa.

The confines of an individual article of furniture is generally defined as the volume of space within which the article of furniture fits. For example, the confines of the sofa may generally be defined as the volume of space within which the component parts of the sofa fit. If the seat bottom and/or skirt is previously removed, then the confines include the volume of space within which the mostly assembled sofa fits. Generally, the component parts that define the confines of the sofa are the back, the pair of front legs, the pair of rear legs, and the arms, if so provided.

It is also to be understood that the confines is not limited to the strict volume within which such component parts fit. Rather, the confines may extend slightly beyond the actual limits of such components. For example, component parts of other pieces of furniture such as a chair may slightly extend beyond the strict limits of the sofa, but may still be considered within the confines of the sofa as defined herein. Additionally, component parts such as the sofa seat and skirt may be placed against the rear of the sofa back, while still being considered part of the sofa confine.

Each of the component parts of the sofa generally contribute to at least one of a height, width, or length dimension of the volume of the confines of the sofa. For example, the pair of front and rear legs may define the width and length of the confines. Further, the bottom surface of the pair of front and rear legs and the top surface of the back of the sofa may define the height of the confines. As discussed above, the confines defined herein may extend slightly beyond these strict limits.

One aspect of the invention is the compact and efficient packaging of individual pieces of furniture into a furniture assembly. Preferably, at least one chair, a coffee table, an end table, an ottoman, and a plurality of cushions and pillows may be substantially assembled within the confines of the sofa.

In another aspect of the invention, a coffee table is placed substantially within the confines of at least one chair, the at least one chair placed substantially within the confines of the sofa.

It is noted herein that the furniture assembly itself has a confine. In the case where the furniture assembly is packaged in a box, the furniture assembly confines is the least amount of rectangular volume needed to enclose all of the separate pieces of furniture in the furniture assembly, including the sofa, after the pieces of furniture have been assembled inside the confines of the sofa.

BRIEF DESCRIPTION OF THE DRAWINGS

The subject matter regarded as the invention is particularly pointed out and distinctly claimed in the concluding portion of the specification. The invention, however, both as to organization and methods of operation, together with features objects, and advantages thereof, may be best understood by reference to the following detailed description when read with the accompanying drawings in which:

DETAILED DESCRIPTION

Figure 1:
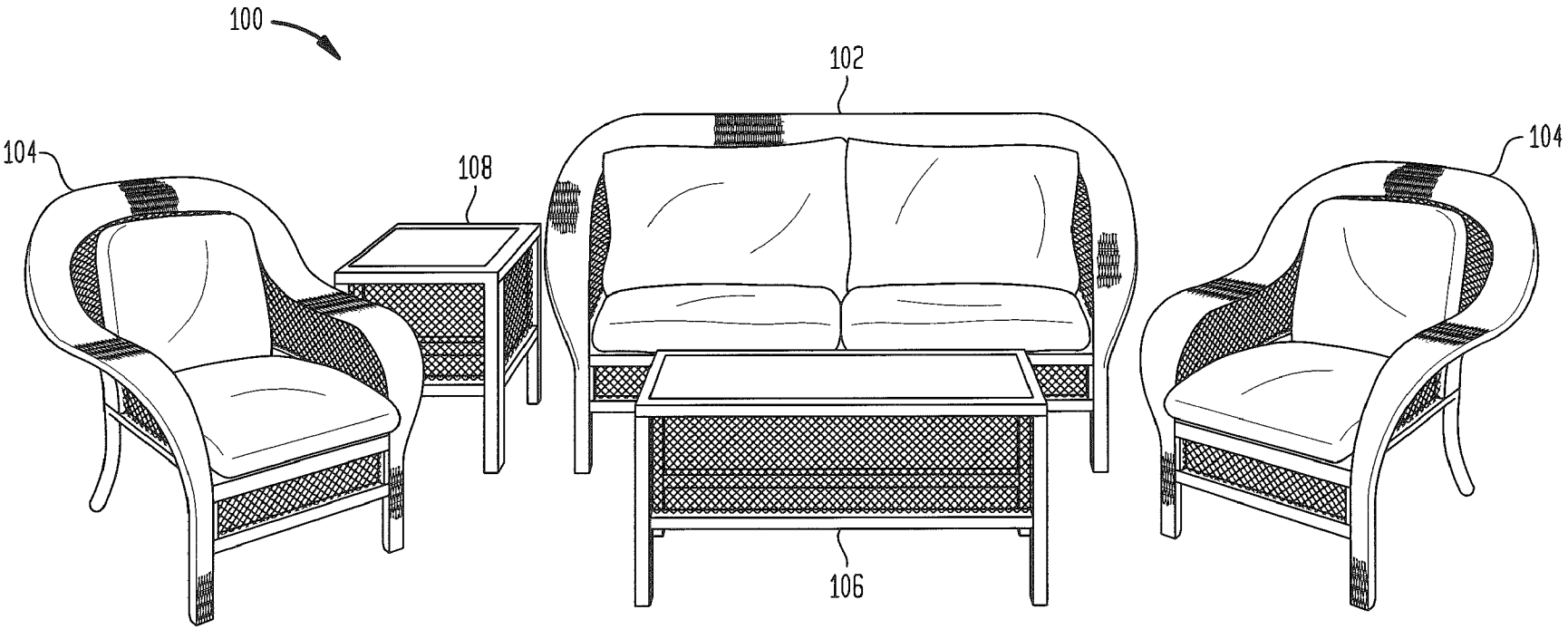
FIG. 1 (PRIOR ART)
FIG. 1 depicts a perspective view of fully assembled prior art furniture having only front skirts, the furniture including two chairs, a sofa, an end table.

In the following are described the preferred embodiments of the furniture assembly in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

As used herein, the term chair shall be defined to include its ordinary and usual meaning, including being defined as a piece of furniture comprising a seat, legs, back, and typically arms, designed to accommodate seated persons. This definition is to include chairs having arms or not having arms, as well as those chairs designed to accommodate more than one person, such as chair-and-a-halves.

As used herein, the term sofa shall be defined to include its ordinary and usual meaning, including being defined as a long chair, usually with arms. The use of the term sofa shall not be limiting, and shall be inferred to include couches, loveseats, settees, and the like, with or without arms.

As used herein, the term confines, with respect to the sofa, shall be defined as the volume of space within which the component parts of the sofa fit, inclusive of an adjacent volume beyond these strict confines as previously described herein. Generally, the component parts that define the confine of the sofa are the back, the pair of front legs, and the pair of rear legs. Each of these component parts contribute to at least one of a height, width, and length dimension of the volume of the confines of the sofa. For example, the pair of front and rear legs may generally define the width and length of the confines. Further, the bottom surface of the pair of front and rear legs to the top surface of the back of the sofa may generally define the height of the confines.

The term confine, with respect to the furniture assembly shall be defined as the least amount of rectangular volume needed to enclose all of the pieces of furniture in the furniture assembly, including the sofa, after the pieces of furniture have been assembled generally inside the sofa confines. As with the confines of the individual furniture components, such definition is not a strict mandate, and the confines may extend slightly beyond the absolute minimum volume.

The description of the length, width, and height distances of the confine of the furniture assembly are merely exemplary. It is within the scope of this invention for the length of a sofa, not including arms, to be defined as the distance from the outside side surface of one of the front legs to the outside side surface of another of the front legs, the legs being located on the same horizontal plane. Preferably, the length of a sofa is defined as the furthest two points located on component parts on the left and right side of the sofa, the two points located on a horizontal plane. Preferably, the width of a sofa is defined as the furthest two points located on component parts on the back and front of the sofa, the two points located on another horizontal plane, perpendicular to the horizontal plane defining the length. Preferably, the height of a sofa is defined as the furthest two points located from the bottom surface of the pair of front and rear legs to the top surface of the back of the sofa, the two points located on a vertical plane.

As discussed above, aspects of the present invention comprise combinations of furniture having at least a sofa with a skirt on each of its four sides, and at least one chair, also having a skirt on each of its four sides, where the sofa includes a removable section comprising a seat bottom and the front skirt and the at least one chair comprises a removable seat bottom. Such furniture may then be partially disassembled and packaged in containers with significantly less voids than if packaged wholly assembled, or simply stored in an otherwise compact manner.

Figure 2:
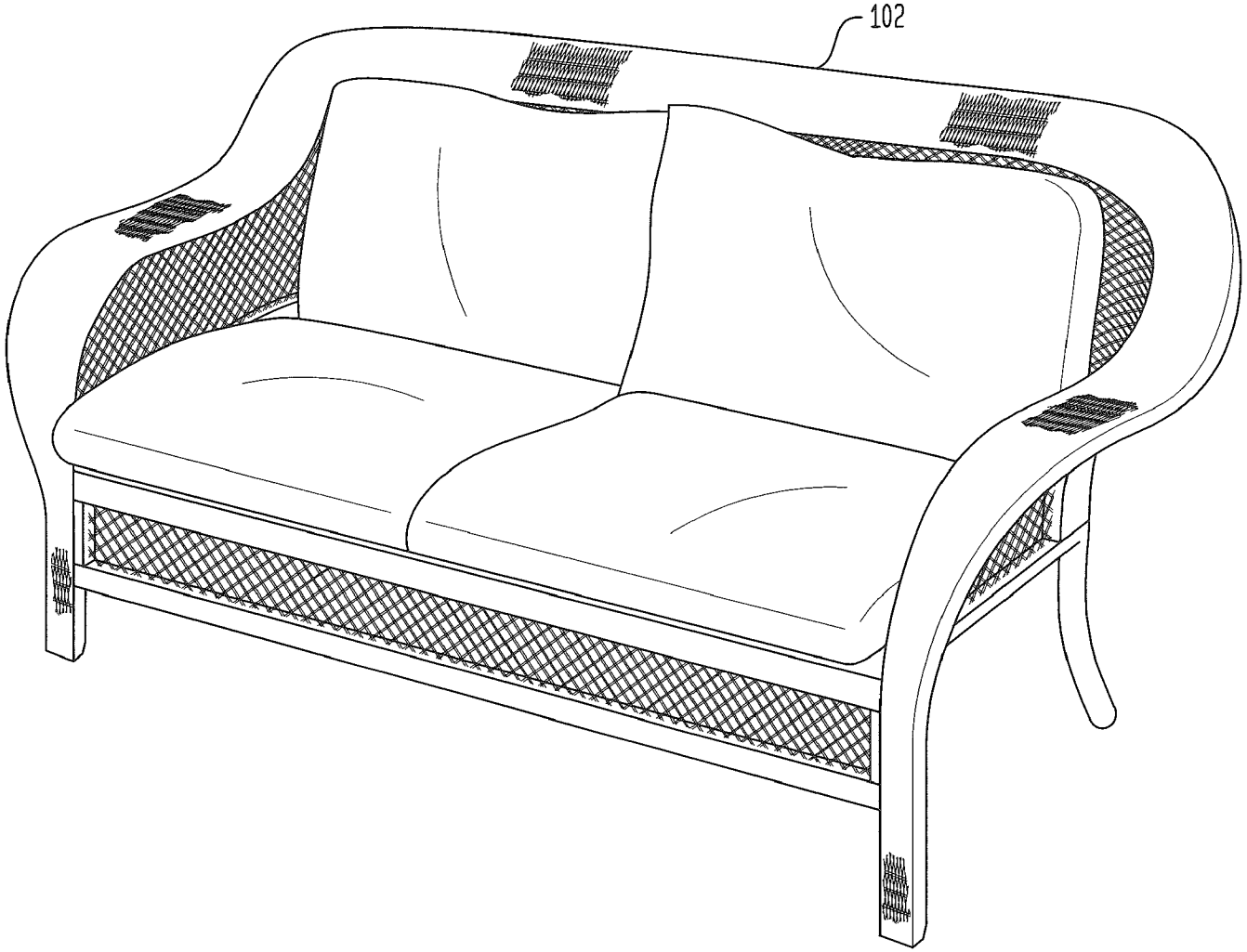
FIG. 2 (PRIOR ART)
FIG. 2 depicts a perspective view of a prior art sofa, such as the sofa shown in FIG. 1.
Figure 3:
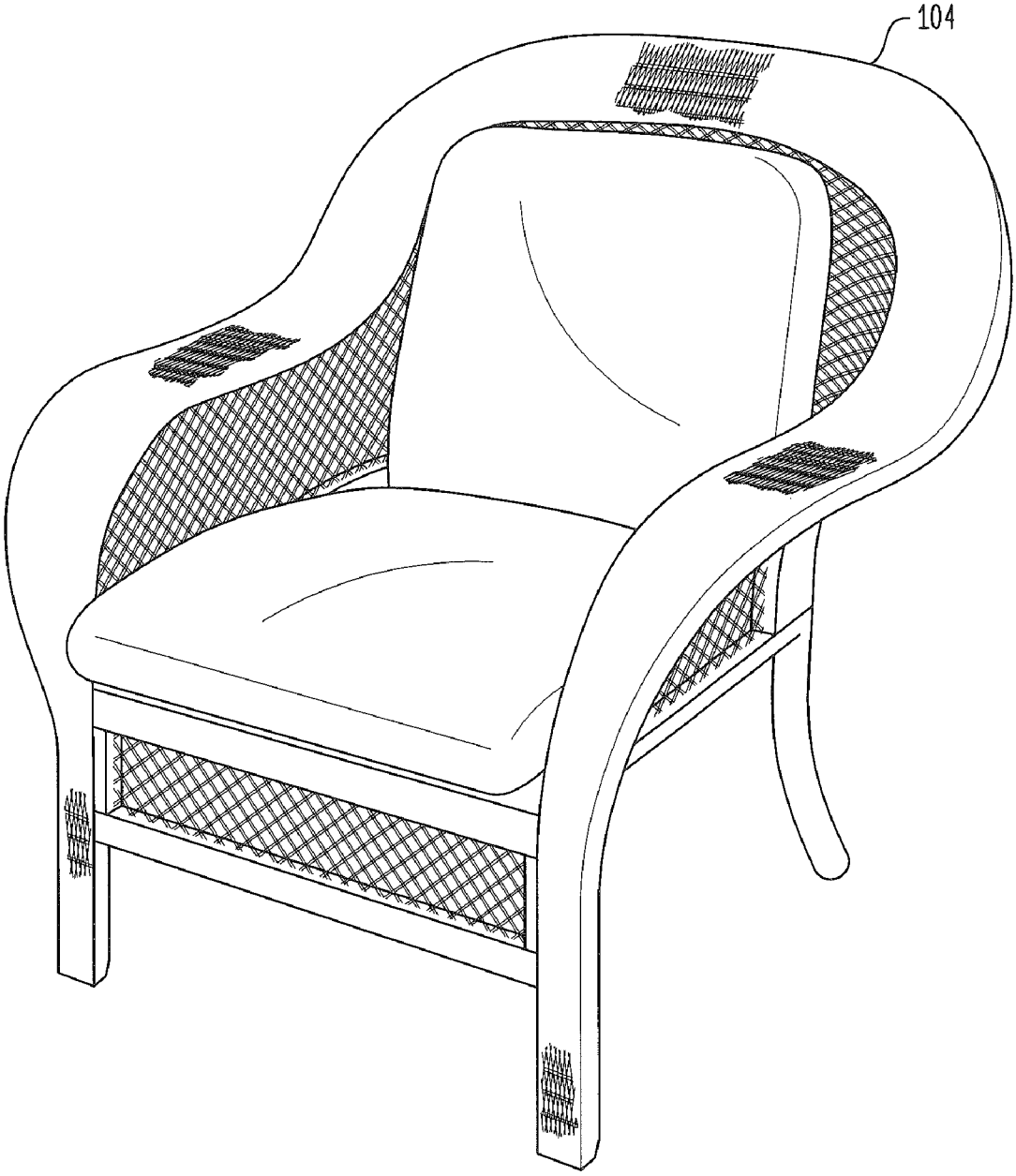
FIG. 3 (PRIOR ART)
FIG. 3 depicts a perspective view of a prior art chair, such as the chair shown in FIG. 1.

Before exploring additional details of the present invention, it is noted that FIGS. 1-3 depict various views of furniture known in the prior art. The furniture 100 may comprise various combinations of sofas 102, chairs 104, coffee tables 106, and end tables 108. Additional items of furniture, such as ottomans, although not shown in FIGS. 1-3, may also be provided. Further, cushions and pillows may be provided for the sofas 102 and chairs 104 (and ottomans if so provided).

As shown in greatest detail in FIGS. 2 and 3, the sofa 102 and chair 104 are only partially skirted, with their skirts extending between only the two front legs of each respective article of furniture. This arrangement is known in the art and permits stacking of the respective articles, to reduce voids when stored or shipped. As discussed above, however, consumers typically find fully skirted furniture more desirable.

As such, fully skirted furniture in accordance with certain aspects of the present invention may be provided. As shown in FIGS. 4-9, one embodiment of the present invention may provide furniture 200 comprising a sofa 202, one or more chairs 204, a coffee table 206, and although not shown, other tables, such as end tables, and other articles, such as ottomans. Various combinations of the furniture 200 articles may also be provided. In addition, various numbers of each respective article of furniture 200 may be provided.

Figure 6:
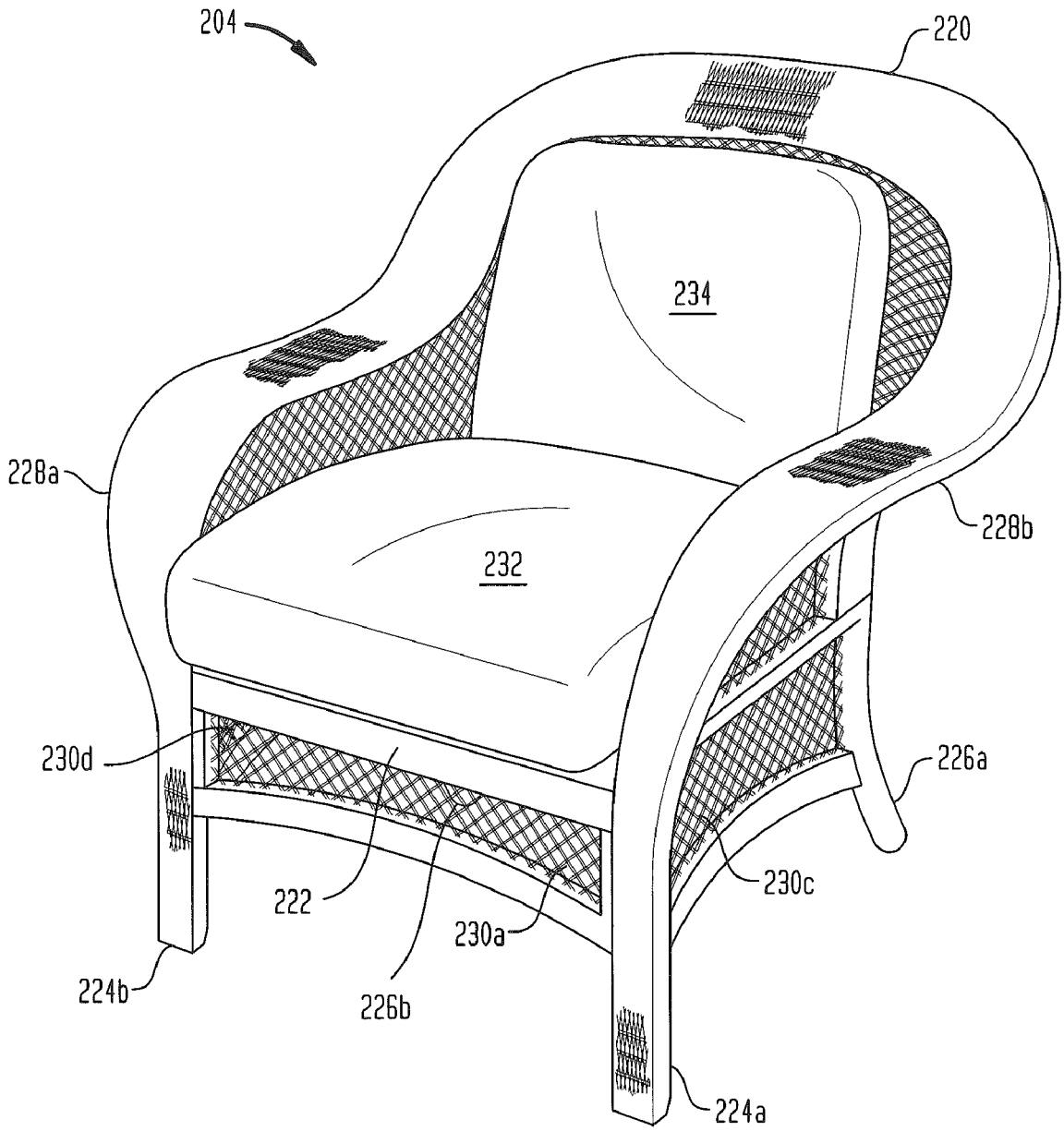
FIG. 6 depicts a perspective view of a chair in accordance with certain aspects of the present invention.
Figure 7:
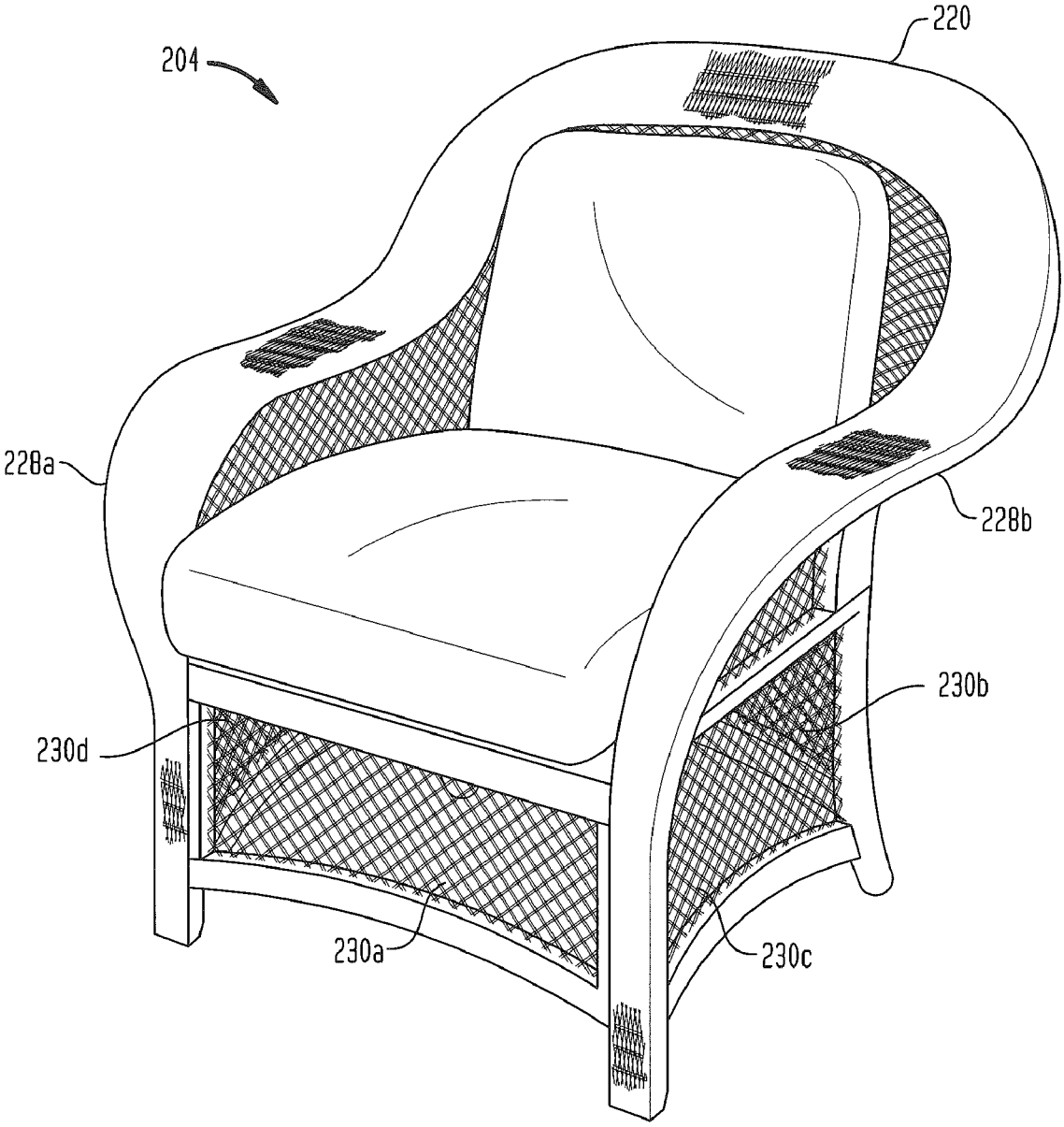
FIG. 7 depicts a perspective view of a chair in accordance with certain aspects of the present invention.

Referring briefly to FIG. 6, it is shown that a finished chair 204 may comprise a back 220, a seat 222, a pair of front legs 224*a*, 224*b*, a pair of rear legs 226*a*, 226*b*, and a pair of arms 228*a*, 228*b*. The chair may also include four skirts, namely a front skirt 230*a* extending between the pair of front legs 224*a*, 224*b*, a rear skirt 230*b*, as seen in FIG. 7, extending between the pair of rear legs 226*a*, 226*b*, and a pair of side skirts 230*c*, 230*d*, extending between one of the front legs and one of the rear legs respectively. Preferably, each side skirt 230*c*, 230*d* is generally parallel to a portion of arms 228*a*, 228*b*. For example, side skirt 230*c* may extend between front leg 224*a* and rear leg 226*a* and side skirt 230*d* may extend between front leg 224*b* and rear leg 226*b*. To complete the chair 202, the chair may also include a seat cushion 232, more generally defined as a cushion, and a back cushion 234, more generally defined as a cushion. Further, chair 204 may also include a throw pillow 234, more generally defined as a pillow. As will be discussed, the seat 222 may be removable.

Figure 8:
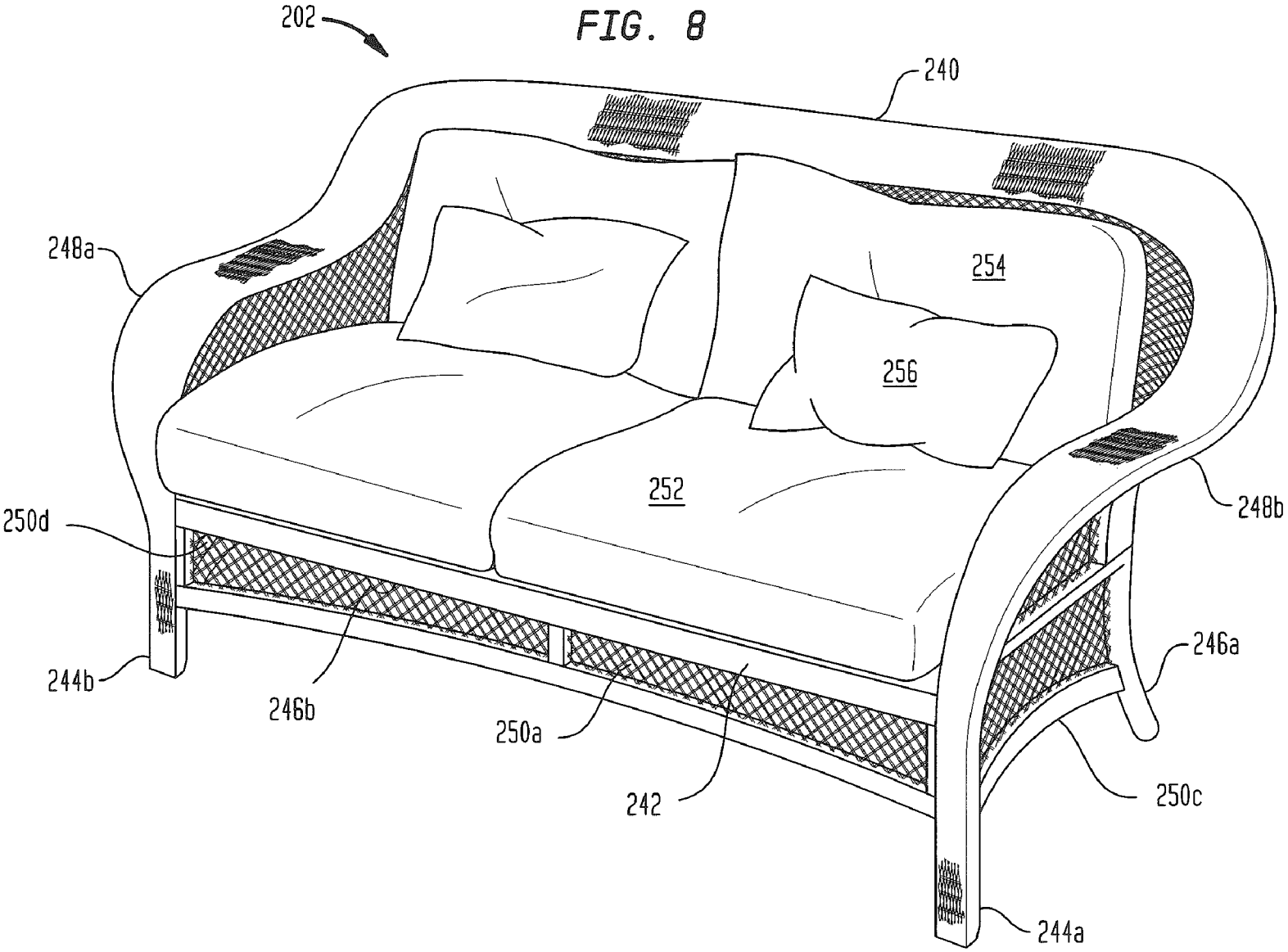
FIG. 8 depicts a perspective view of a sofa in accordance with certain aspects of the present invention.

Referring to FIG. 8, and in a similar respect to the chair 204 of FIG. 6, it is shown that a finished sofa 202 may comprise a back 240, a seat 242, a pair of front legs 244*a*, 244*b*, a pair of rear legs 246*a*, 246*b*, and a pair of arms 248*a*, 248*b*. The chair may also include four skirts, namely a front skirt 250*a* extending between the pair of front legs 244*a*, 244*b*, a rear skirt 250*b* extending between the pair of rear legs 246*a*, 246*b*, and a pair of side skirts 250*c*, 250*d*, extending between one of the front legs and one of the rear legs respectively. Preferably, each side skirt 250*c*, 250*d* are generally parallel to a portion of arms 248*a*, 248*b*. For example, side skirt 250*c* may extend between front leg 244*a* and rear leg 246*a* and side skirt 250*d* may extend between front leg 244*b* and rear leg 246*b*. To complete the sofa 204, the sofa may also include one or more seat cushions 252, more generally defined as cushions, and one or more back cushions 254, more generally defined as cushions. Further, sofa 204 may also include a throw pillow 256, more generally defined as a pillow. Throw pillows 234 may also be provided. As will be discussed, the front skirt 250*a* and seat 242 may be removable as a single unit. Further, seat 242 may be removed while front skirt 250*a* is non-removable.

Figure 9:
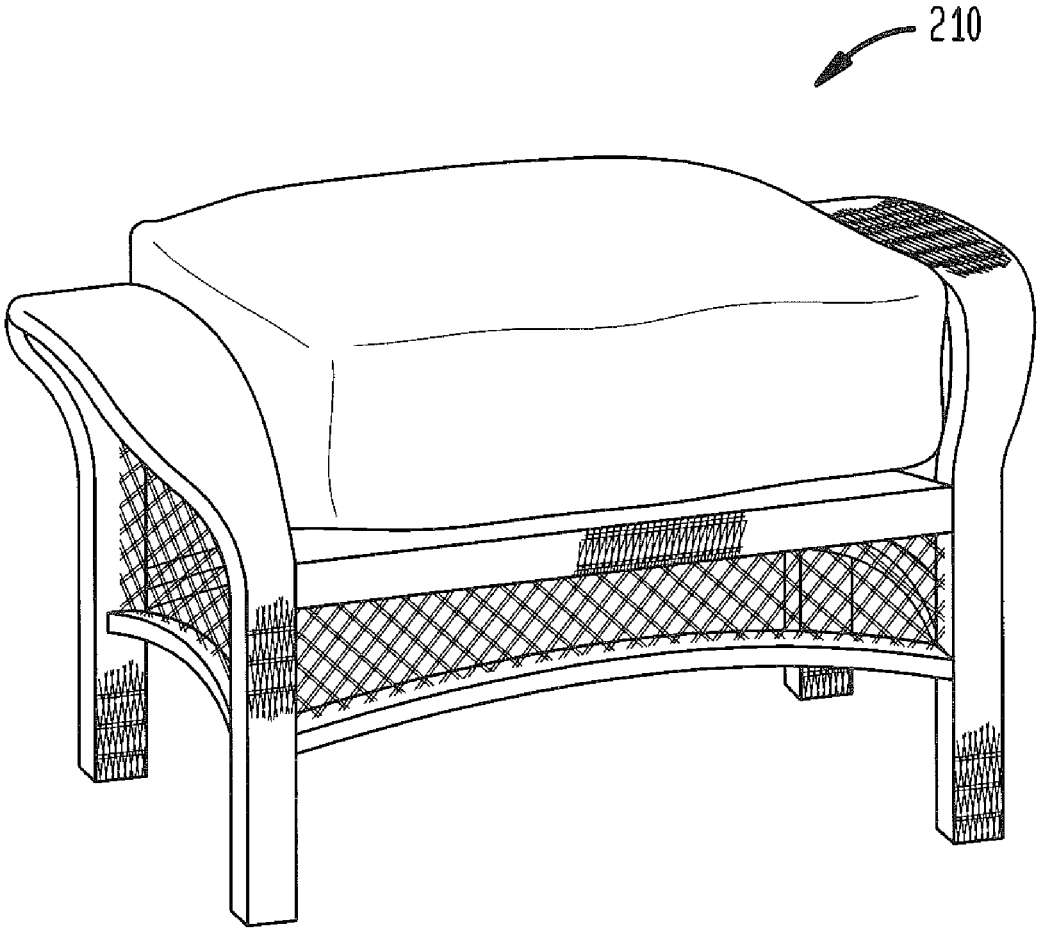
FIG. 9 depicts a perspective view of an ottoman in accordance with certain aspects of the present invention.

Referring to FIG. 9, there is shown an ottoman 210, which may also be provided. The ottoman 210 component parts are typical of conventional ottomans, and may include skirts which are not removable. Preferably, the ottoman includes a seat, a pair of arms, a pair of front legs, a pair of rear legs, and four skirts. Ottoman 210 may also include a seat cushion, more generally defined as a cushion.

Figure 4:
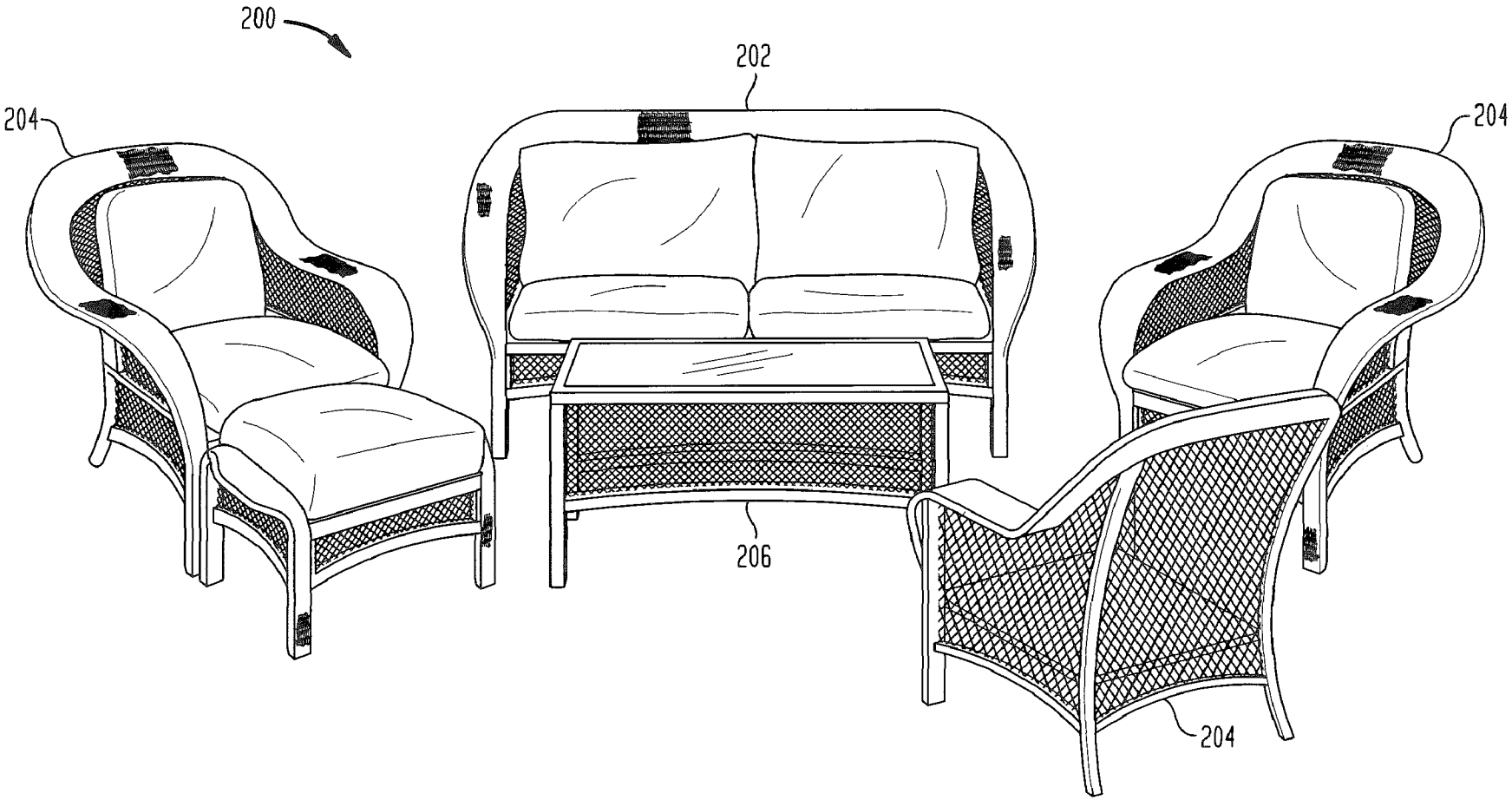
FIG. 4 depicts a perspective view of furniture in accordance with certain aspects of the present invention, the furniture including a sofa, three chairs, and coffee table.
Figure 5:
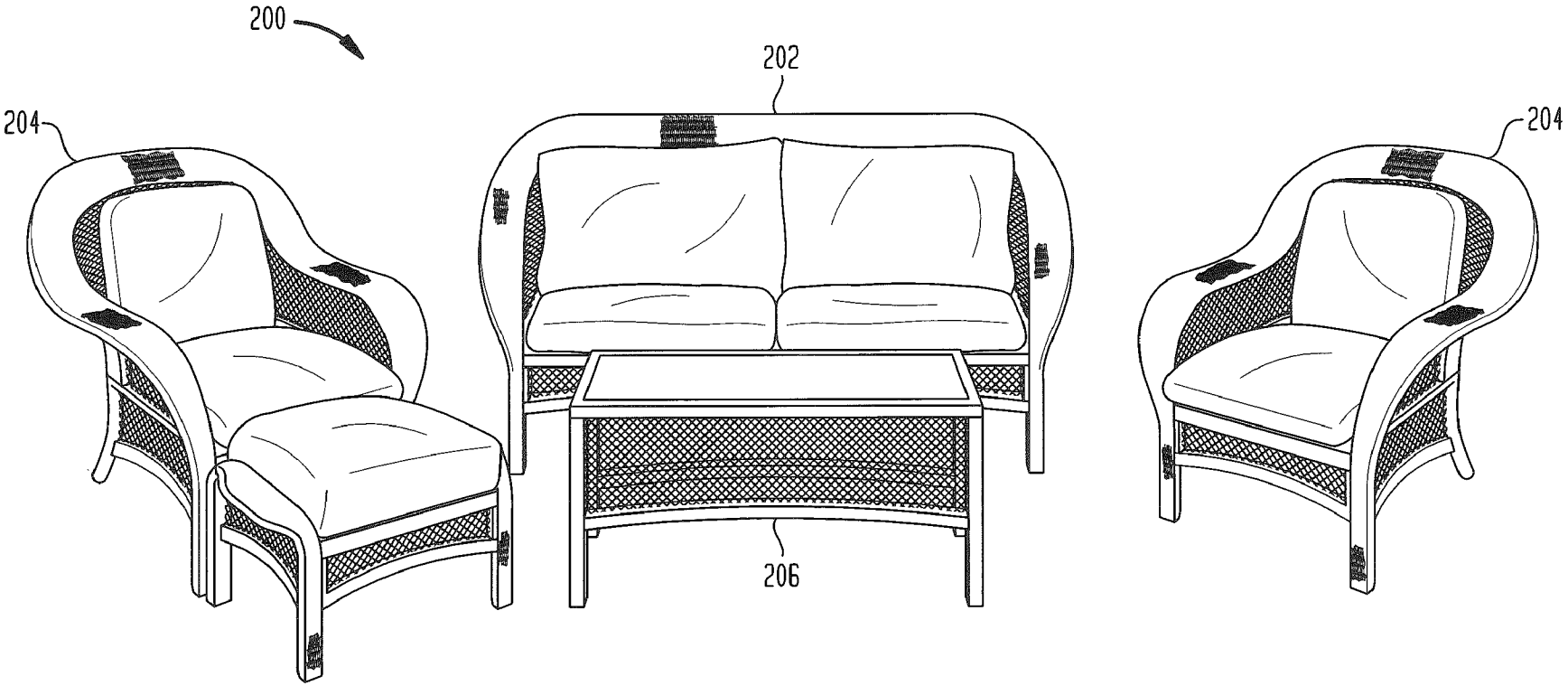
FIG. 5 depicts a perspective view of furniture in accordance with certain aspects of the present invention, the furniture including a sofa, two chairs, and a coffee table.
Figure 10:
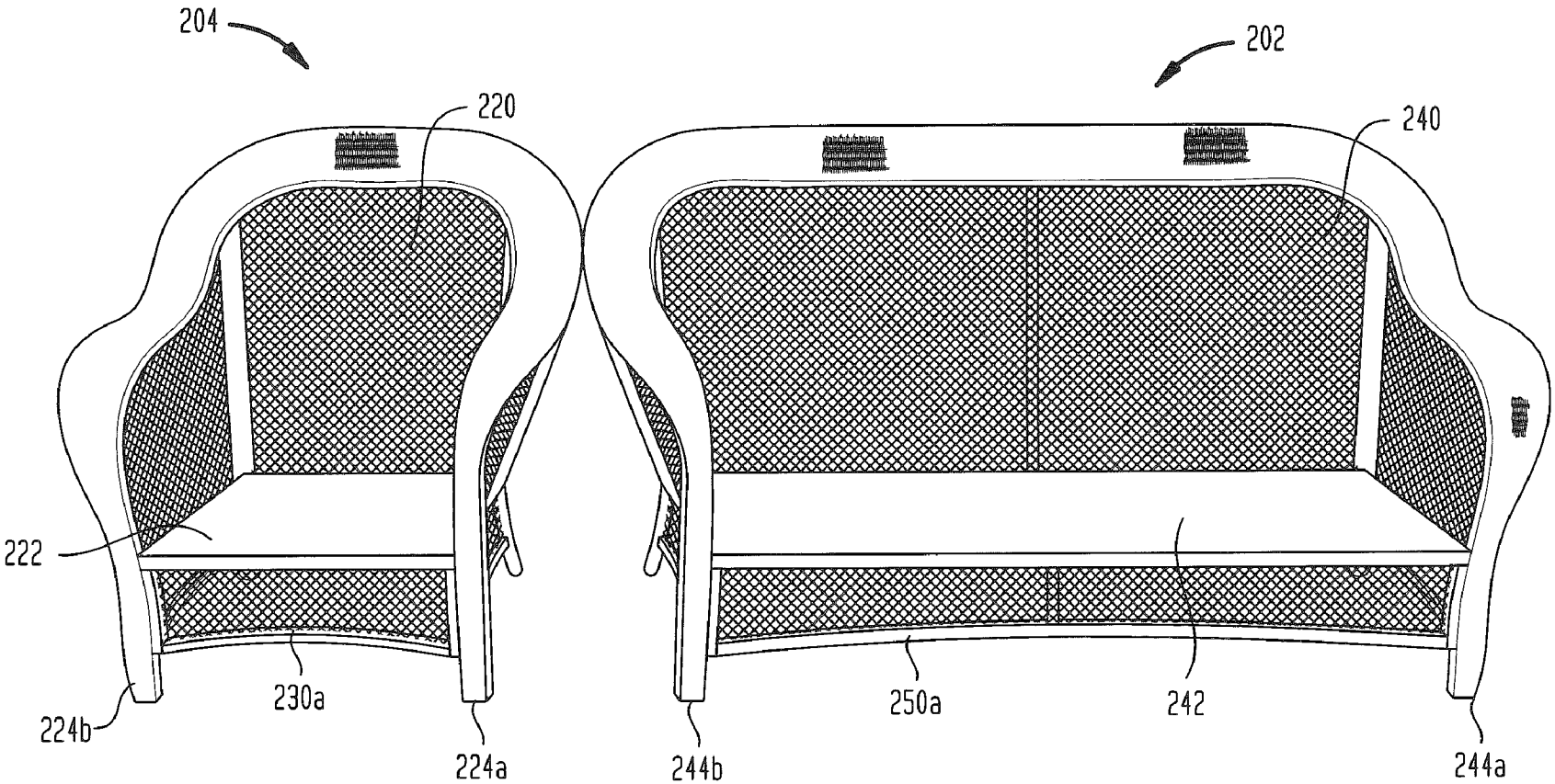
FIG. 10 depicts a frontal view of a sofa and chair with cushions and pillows removed, the sofa having a removable seat bottom and front skirt and the chair having a removable seat bottom, in accordance with particular aspects of the present invention.
Figure 11:
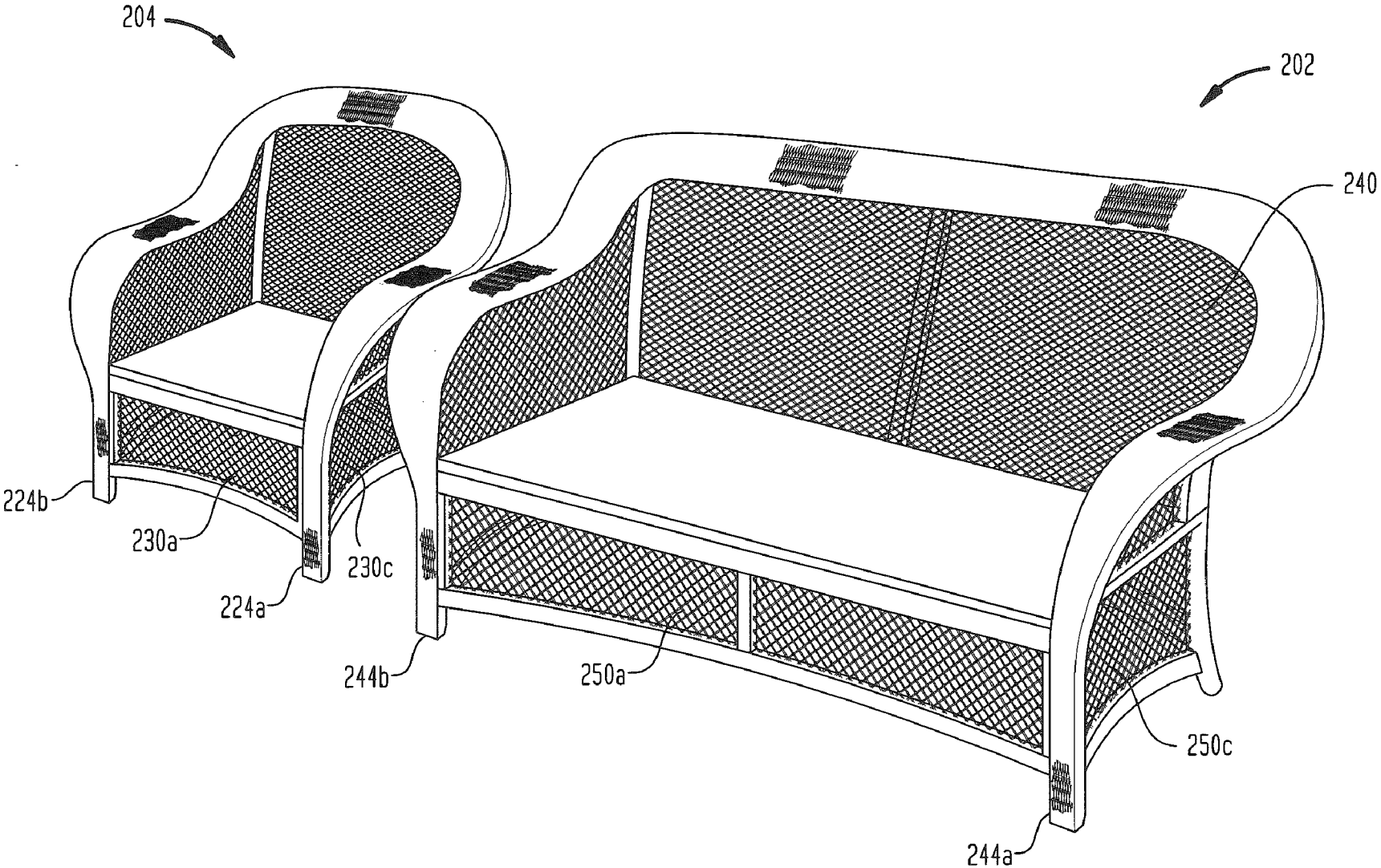
FIG. 11 depicts a three-quarter perspective view of the front and side of the sofa and chair of FIG. 10.
Figure 12:
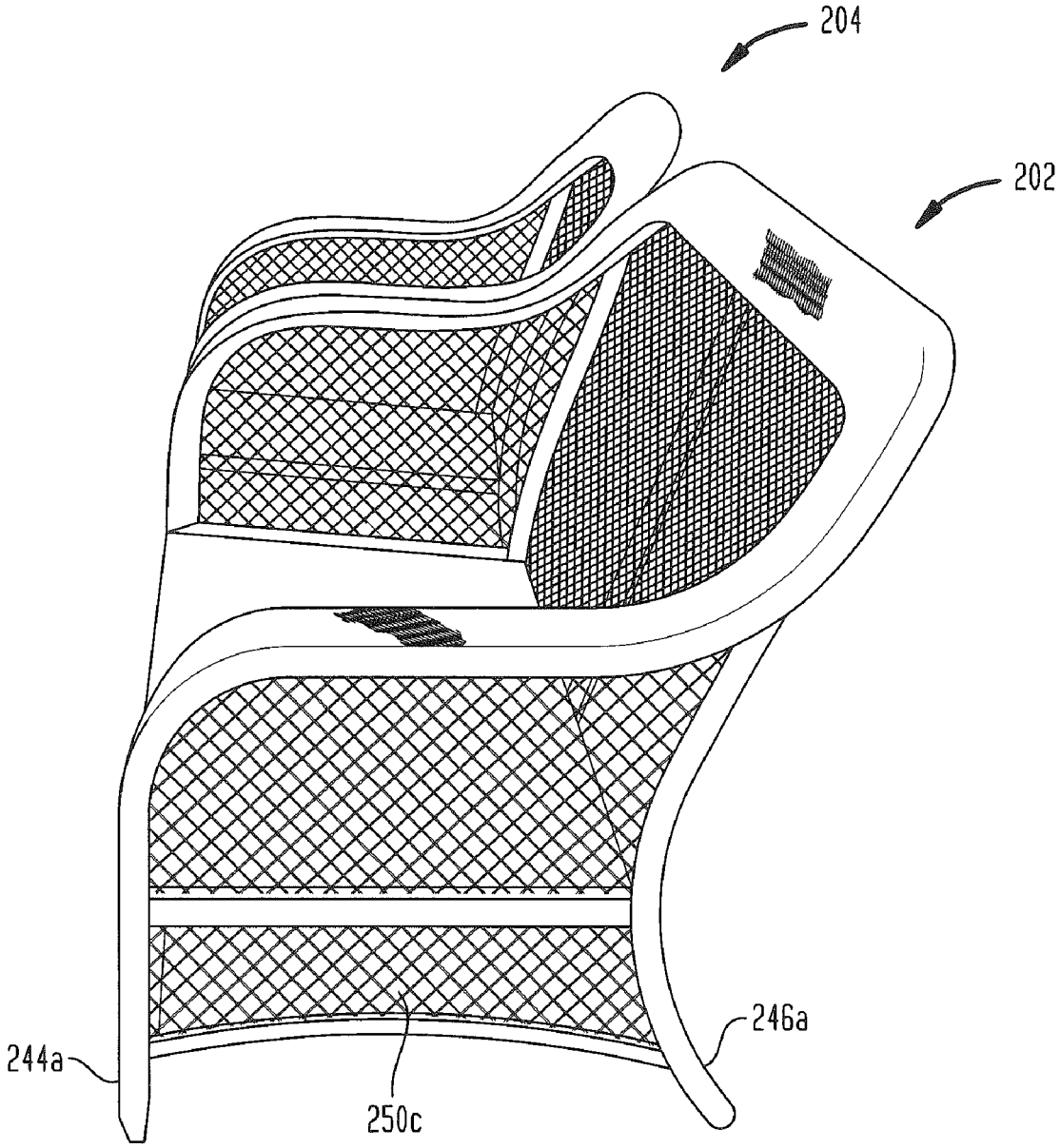
FIG. 12 depicts a side view of the sofa and chair of FIG. 10.
Figure 13:
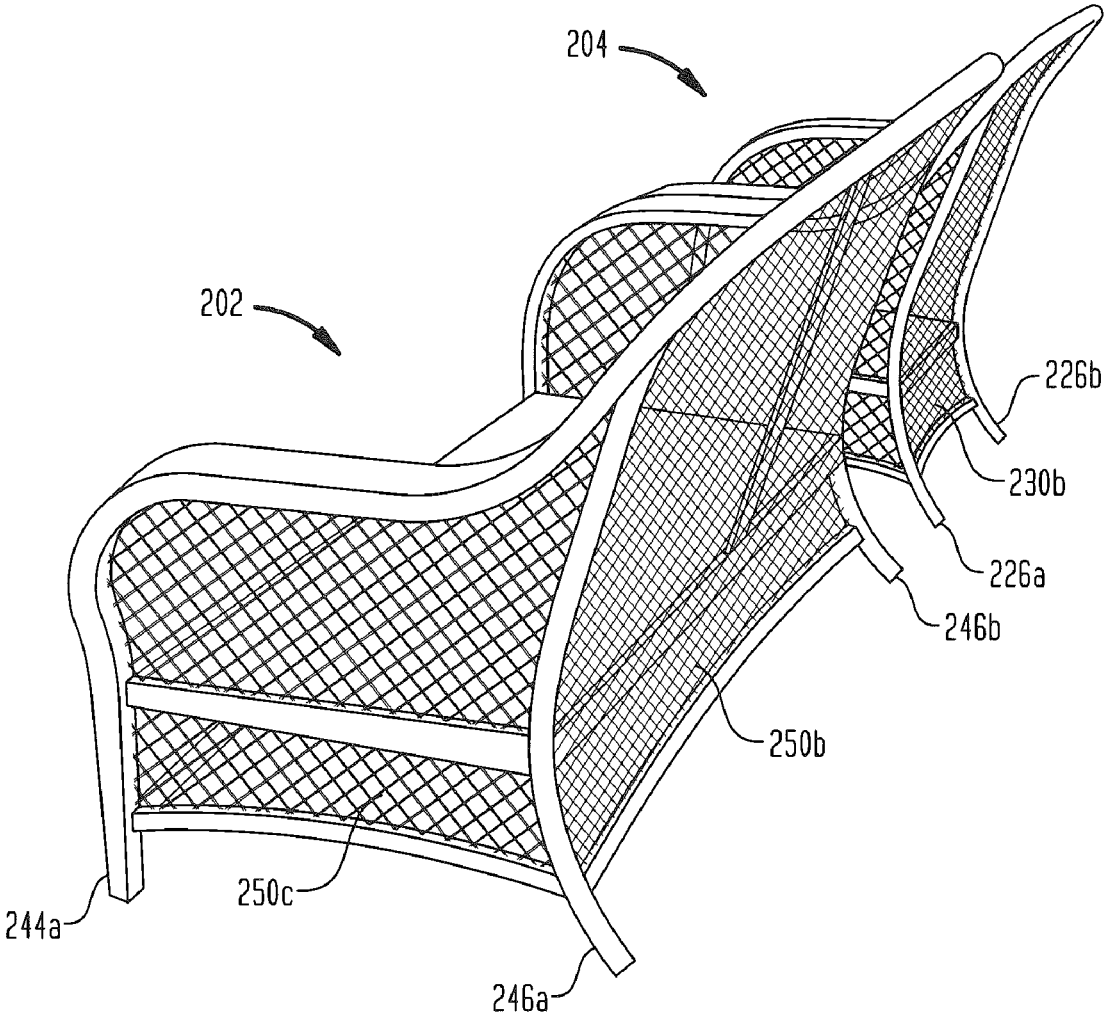
FIG. 13 depicts a three-quarter perspective view of the rear and side of the sofa and chair of FIG. 10.
Figure 14:
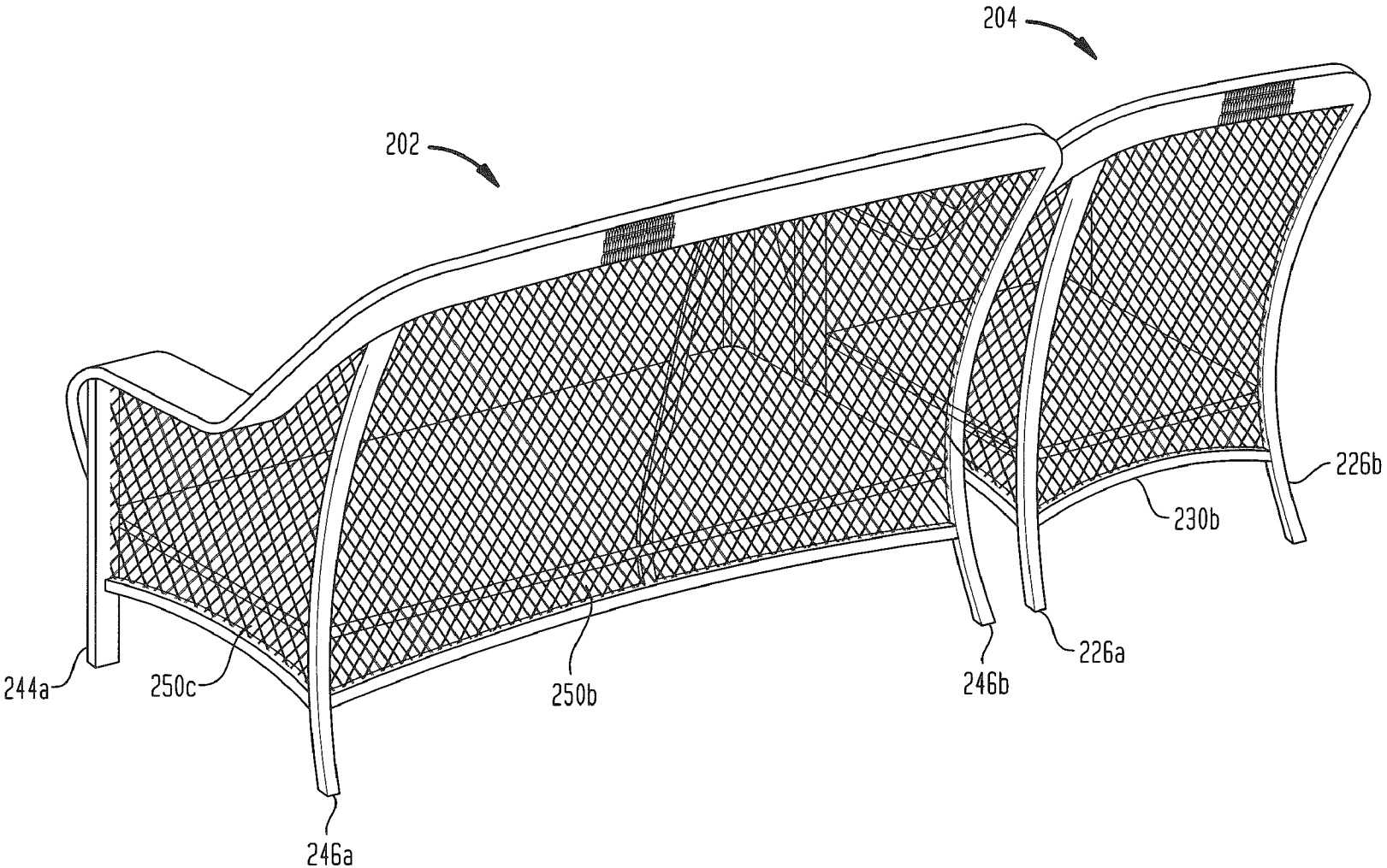
FIG. 14 depicts a further perspective view of the rear and side of the sofa and chair of FIG. 10.
Figure 15:
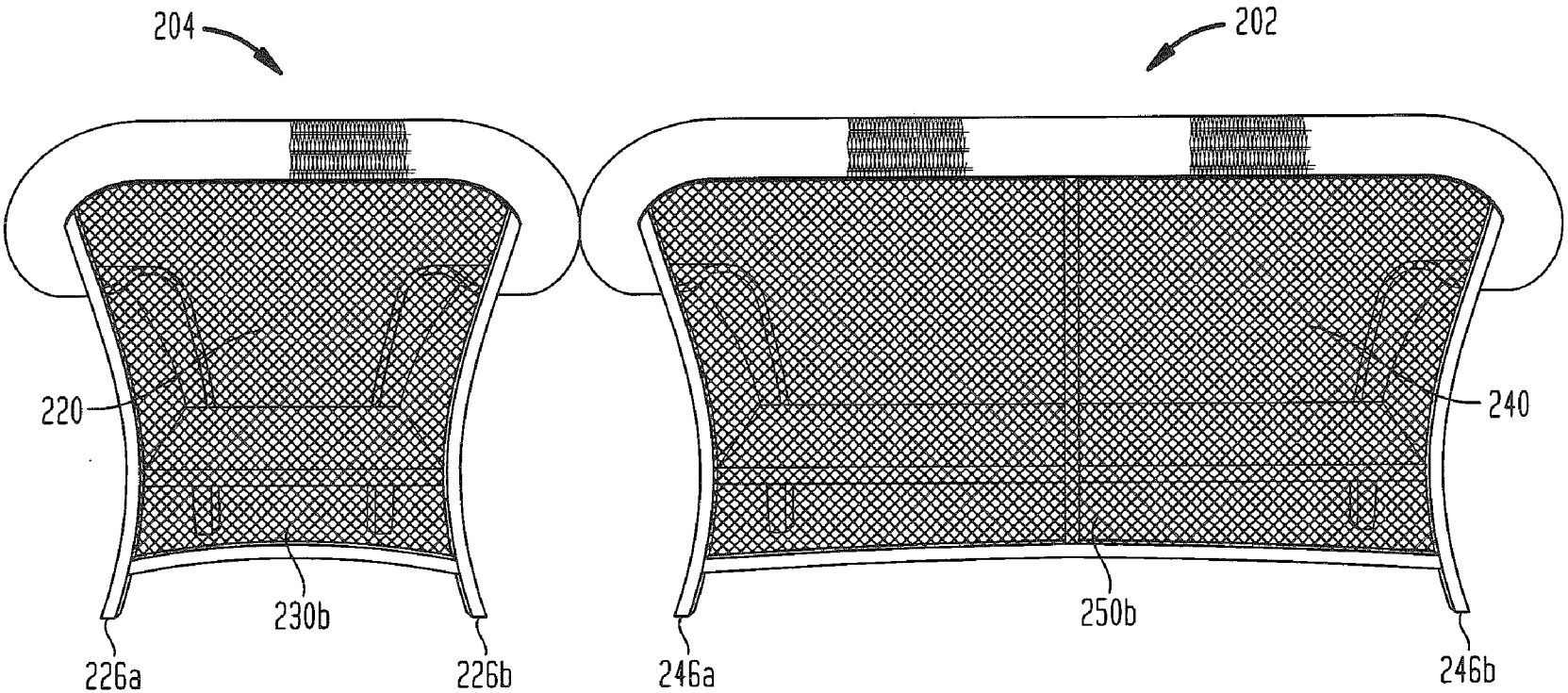
FIG. 15 depicts a rear view of the sofa and chair of FIG. 10.
Figure 16:
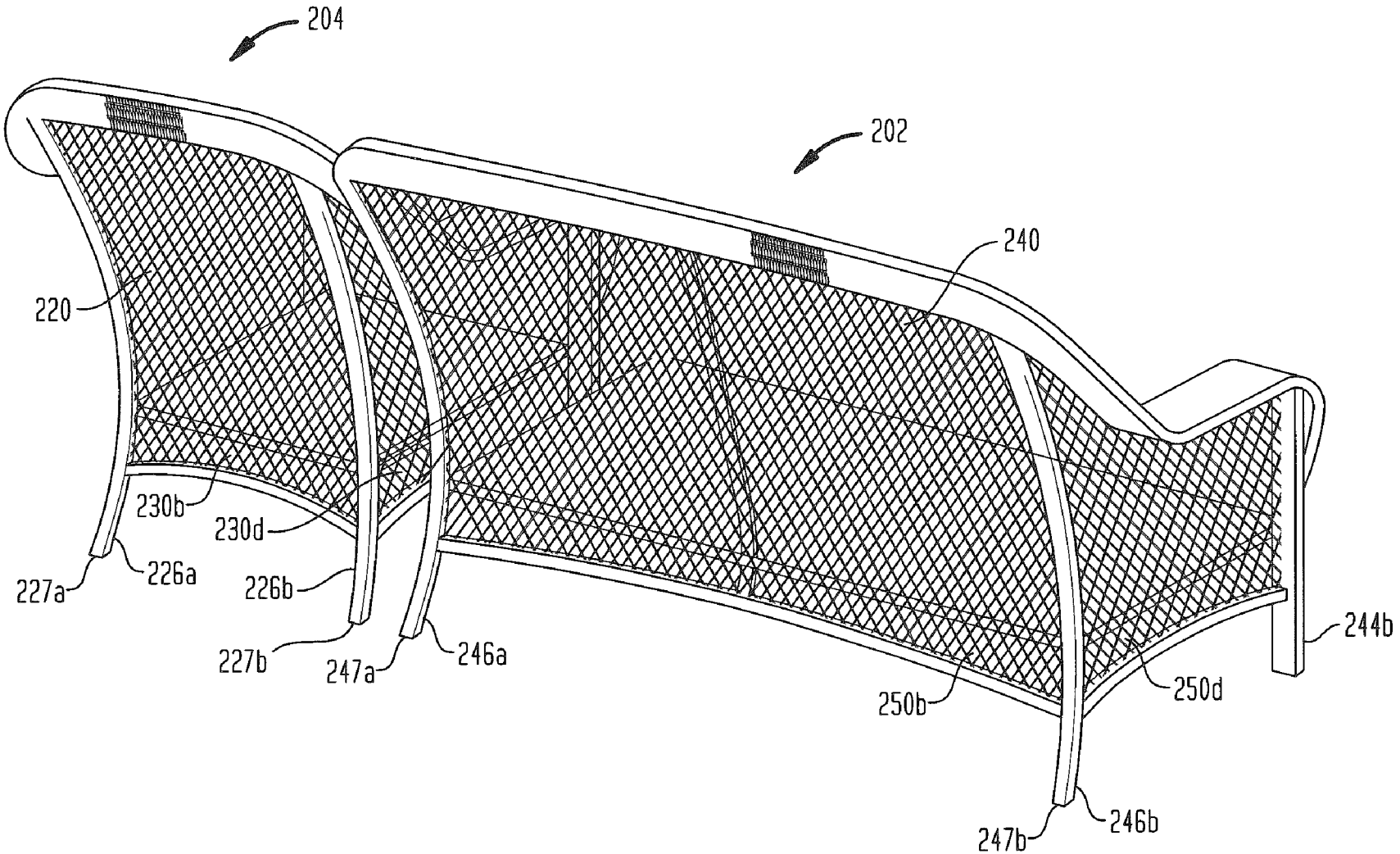
FIG. 16 depicts a further perspective view of the rear and side of the sofa and chair of FIG. 10.
Figure 17:
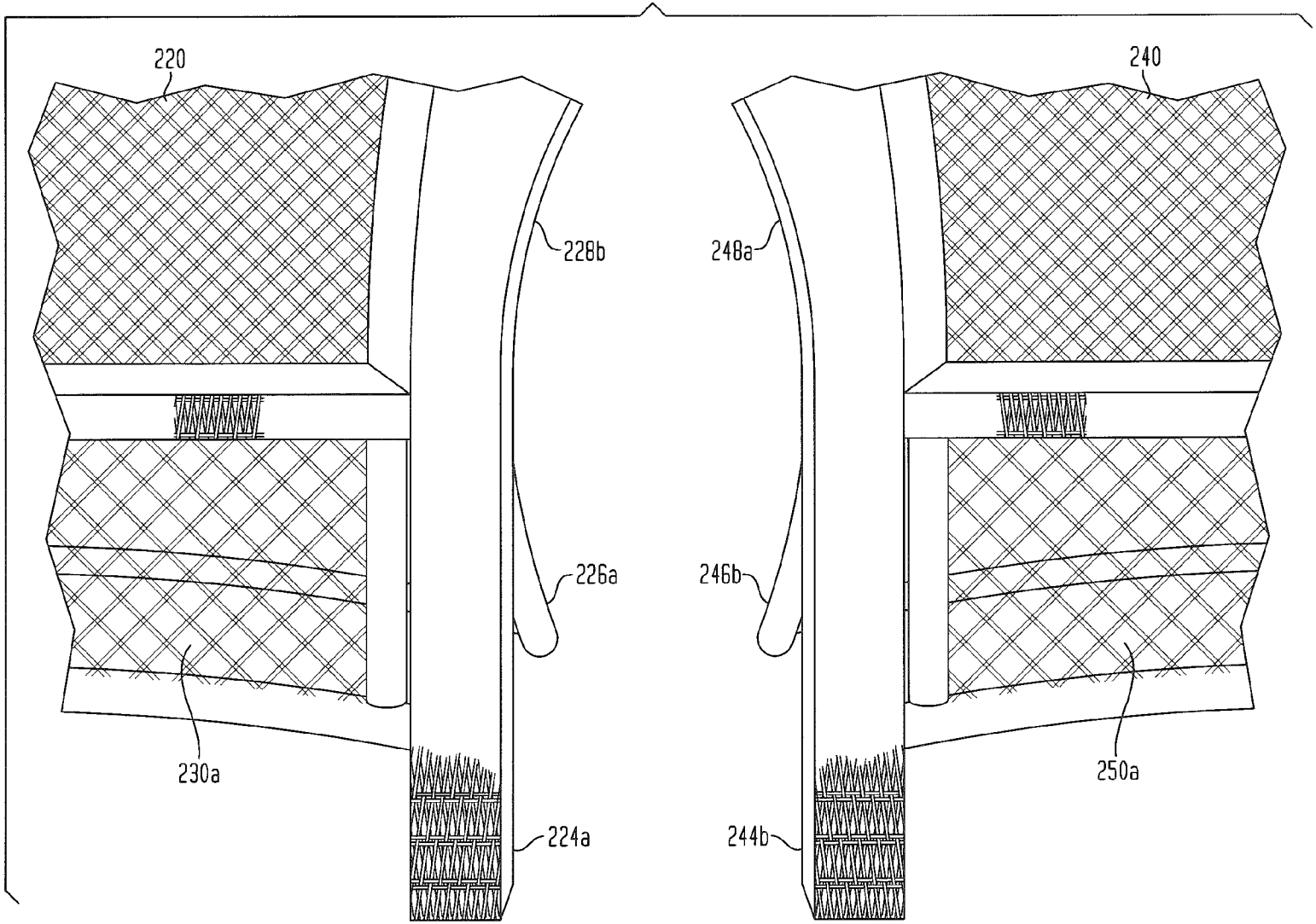
FIG. 17 depicts a blown-up frontal view of portions of the sofa and chair of FIG. 10.

FIGS. 10-17 depict various views of the sofa 202 and chair 204 of FIG. 4, side-by-side, without any cushions 232, 234, 252, 254, or throw pillows 256, for clarity. FIG. 10 is a front view, FIG. 12 is a side view, and FIG. 15 is a rear view. FIG. 17 is a blown-up view depicting portions of the sofa 202 and chair 204.

Figure 18:
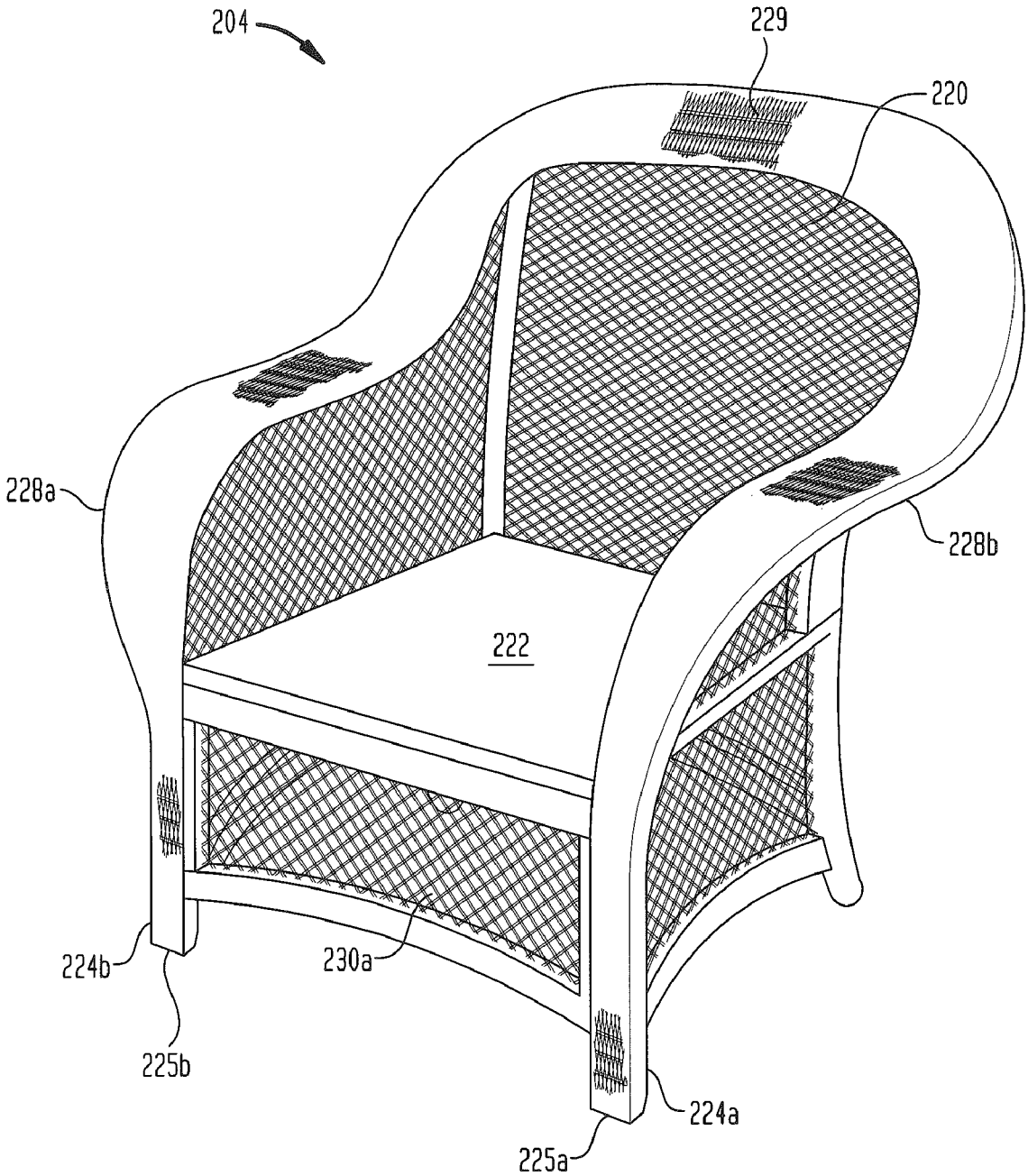
FIG. 18 depicts a step in the method of disassembling the chair shown in FIGS. 10-17.

FIG. 18 depicts a chair 204, such as the chair shown in FIGS. 4, 6, and 10-17. In this view, the seat 222 may be clearly seen. The seat 222 is arranged to be easily removable from the remainder of the chair 204, such that it may be removed during storage or packing. In this regard, the skirts 230*a*, 230*b*, 230*c*, and 230*d* may include brackets upon which the seat 222 may rest when installed. Preferably, seat 222 includes four brackets 238*a-d*, which the corners of seat 22 may rest on.

Figure 19:
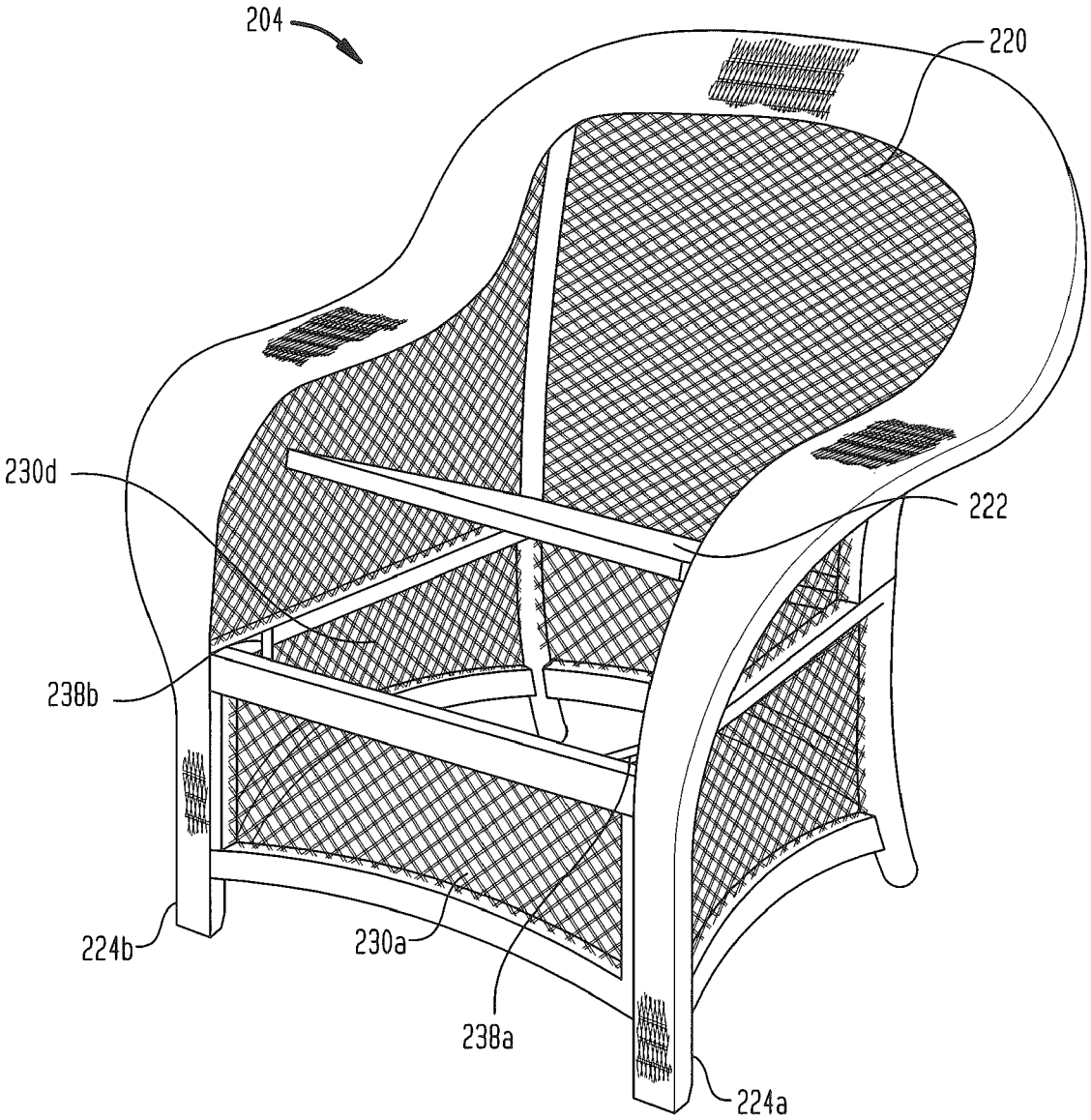
FIG. 19 depicts another step in the method of disassembling the chair shown in FIGS. 10-17.
Figure 20:
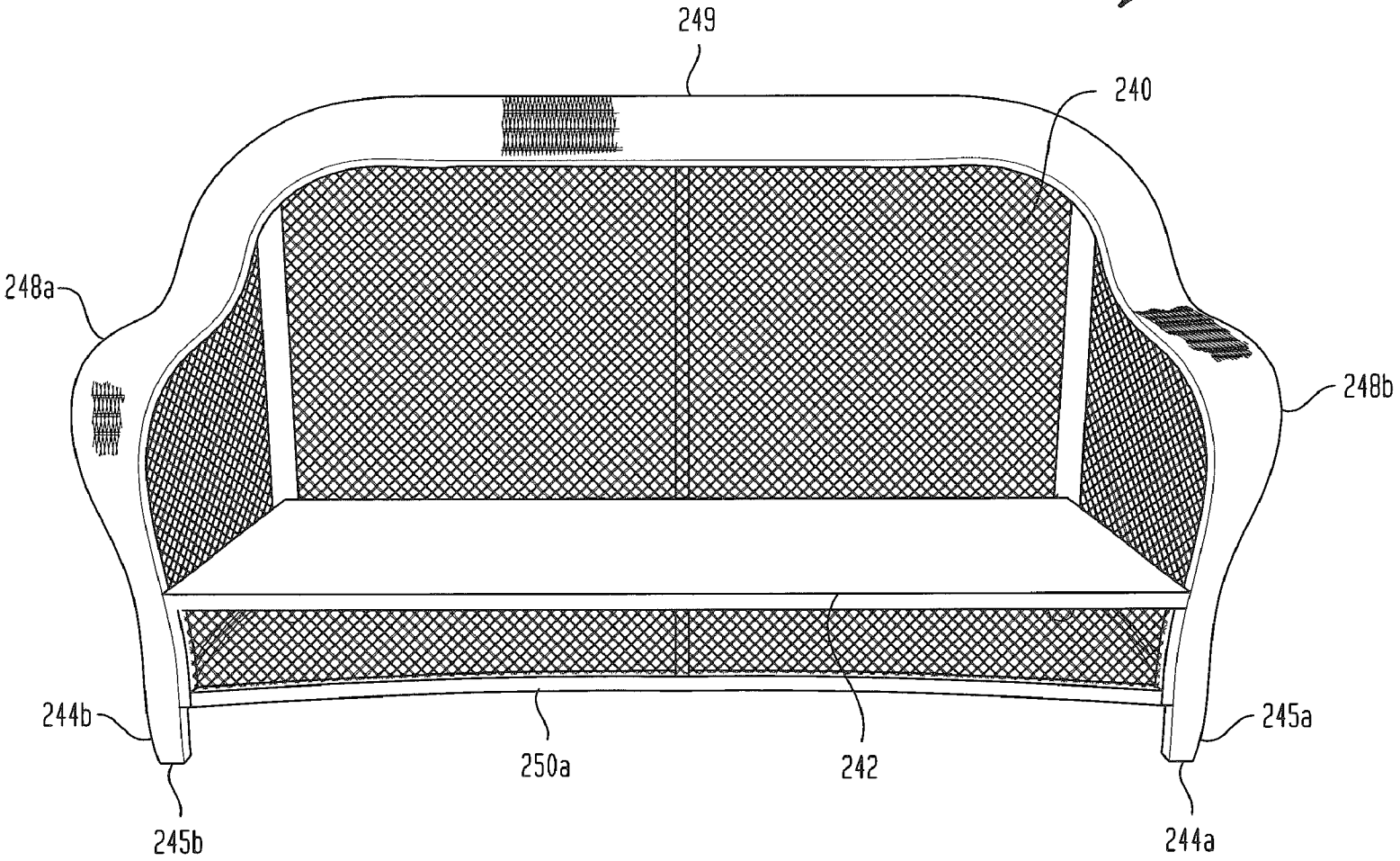
FIG. 20 depicts a step in the method of disassembling the sofa shown in FIGS. 10-17.
Figure 21:
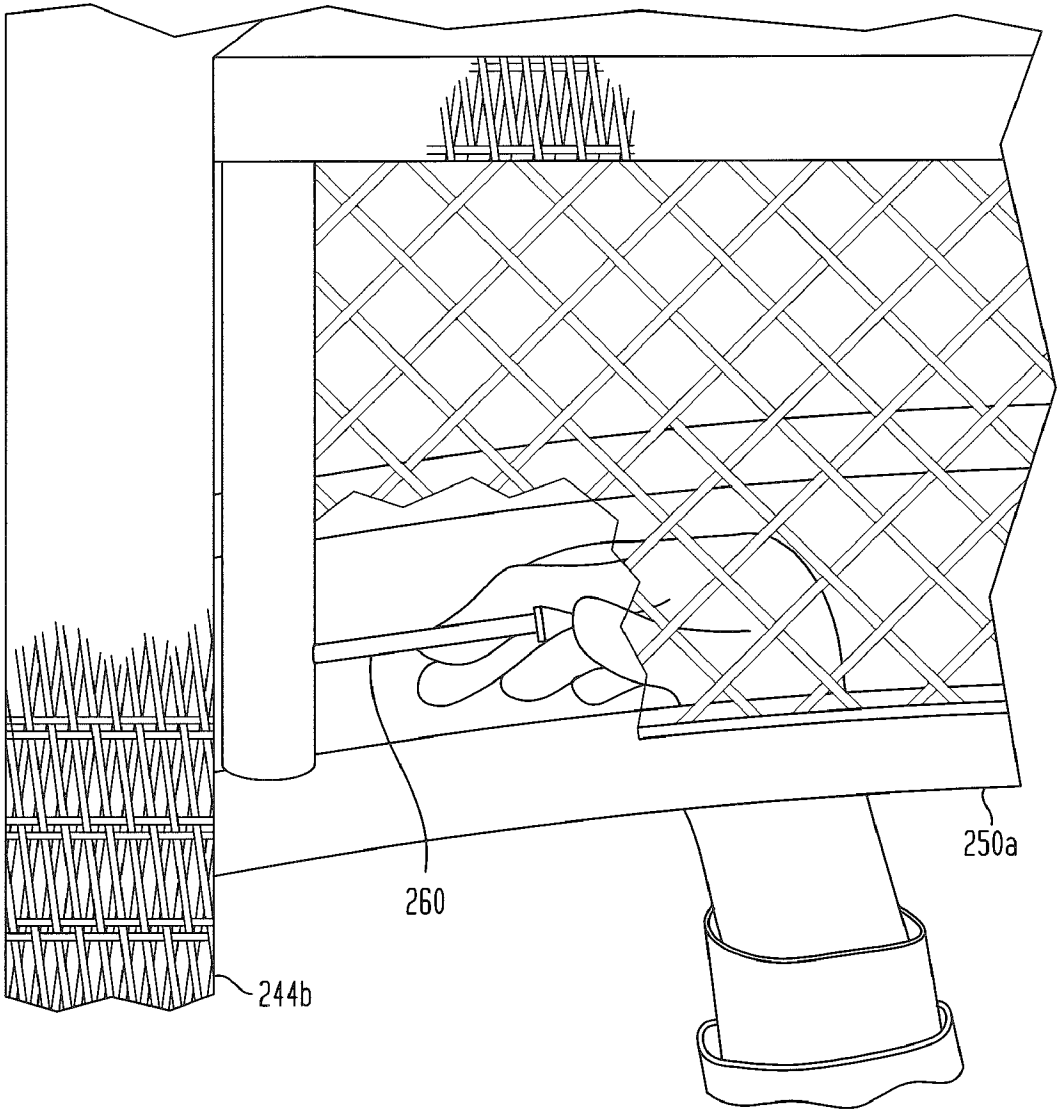
FIG. 21 depicts another step in the method of disassembling the chair shown in FIGS. 10-17.
Figure 22:
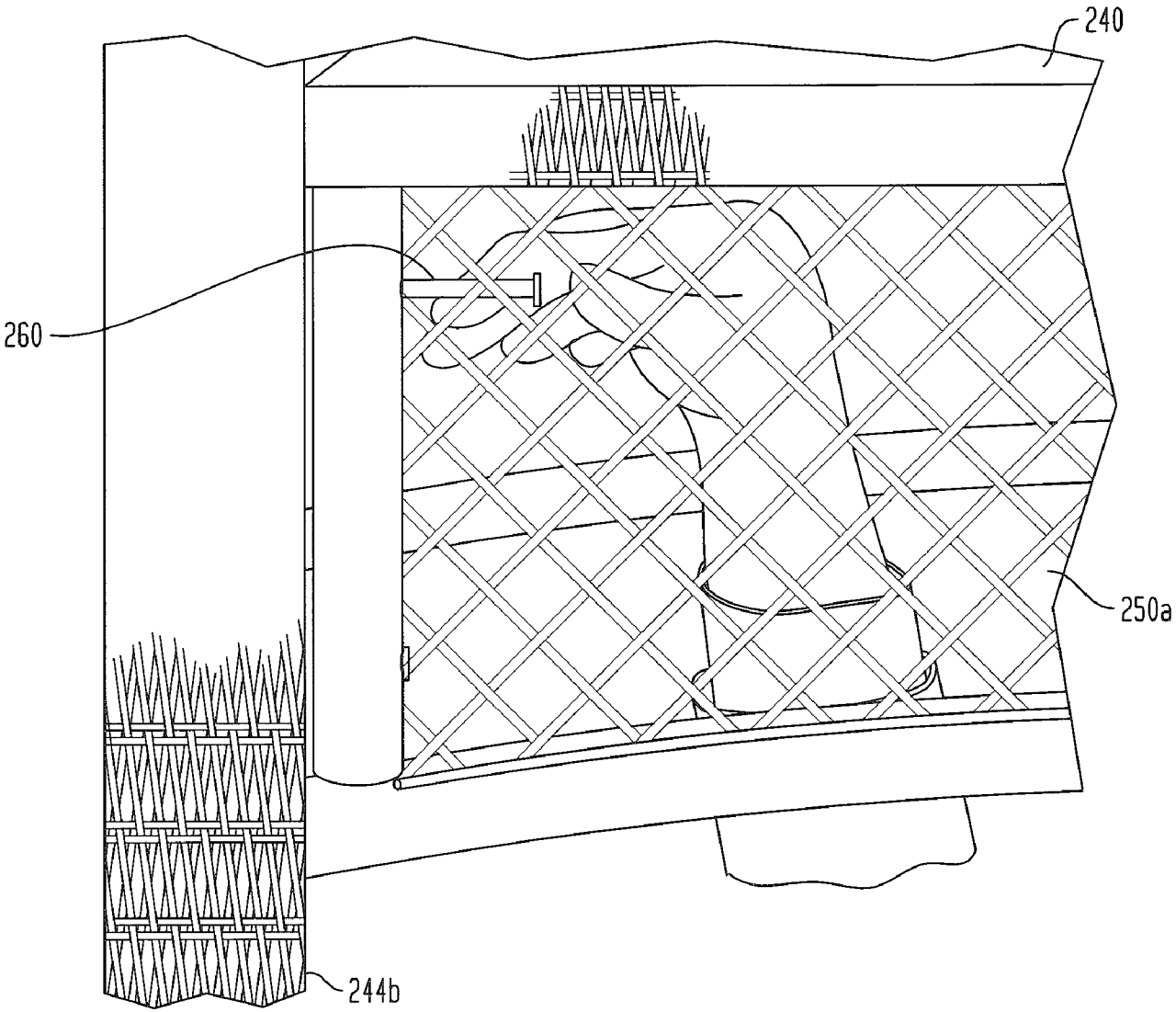
FIG. 22 depicts still another step in the method of disassembling the chair shown in FIGS. 10-17.
Figure 23:
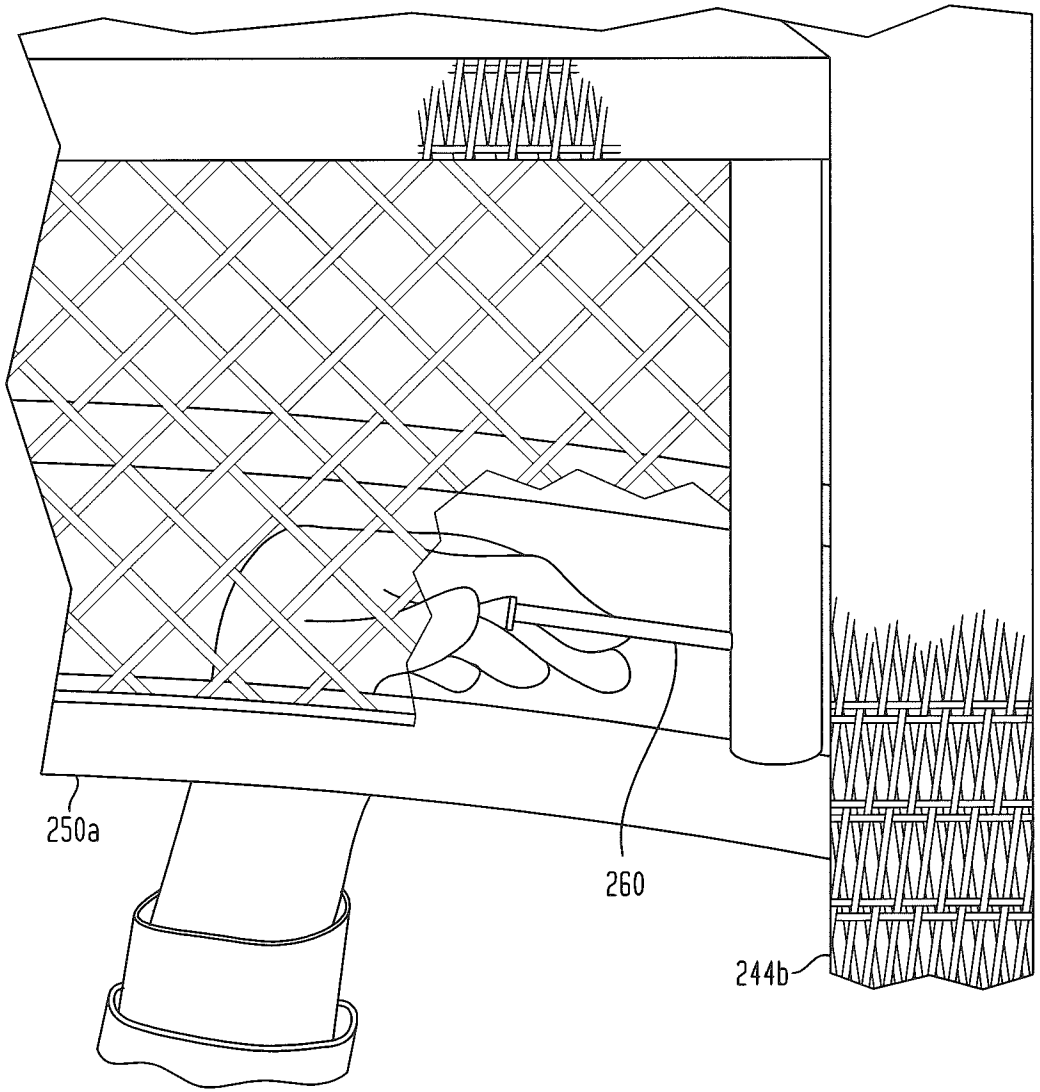
FIG. 23 depicts a further step in the method of disassembling the chair shown in FIGS. 10-17.
Figure 24:
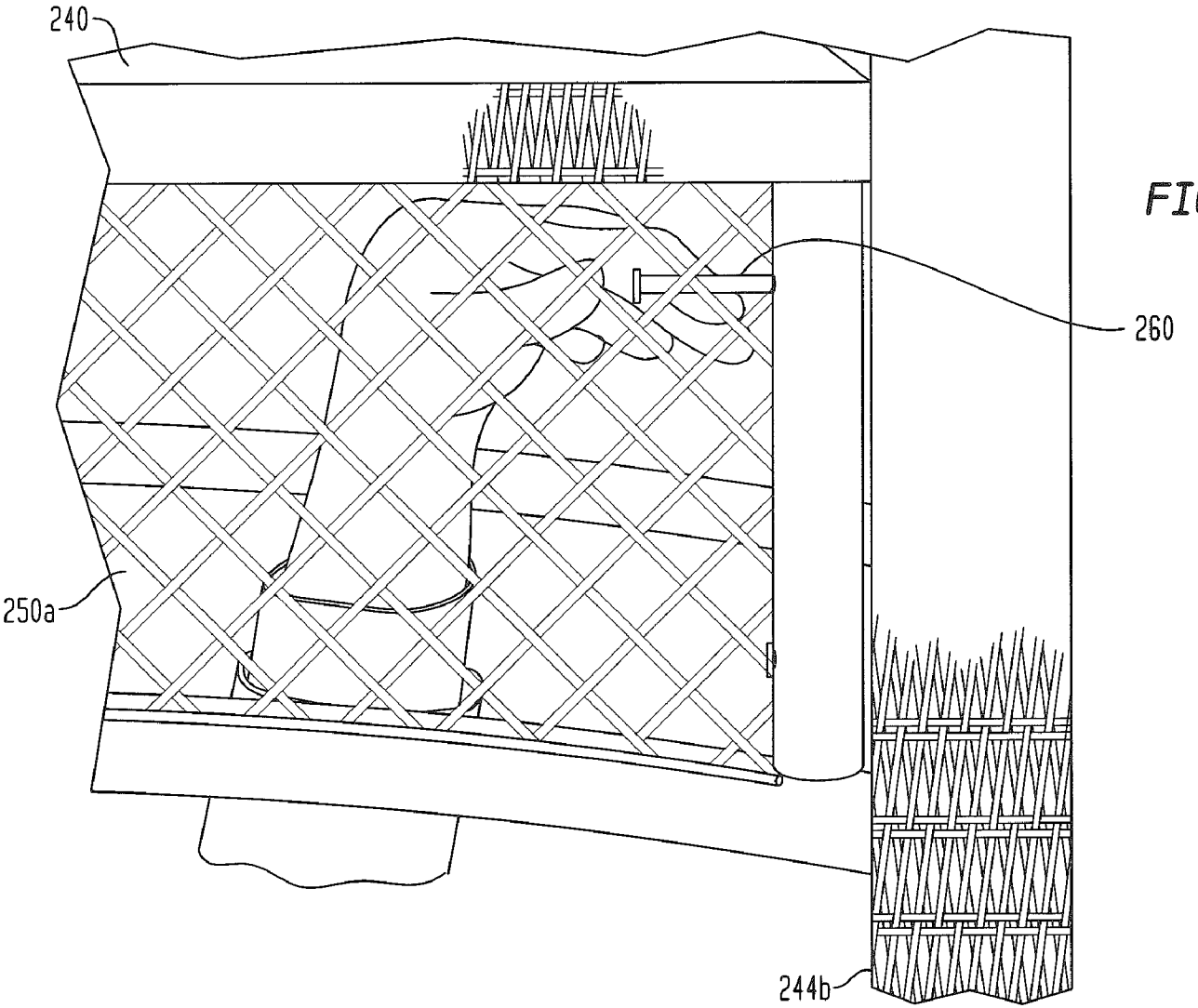
FIG. 24 depicts yet another step in the method of disassembling the chair shown in FIGS. 10-17.

Two of the brackets 238*a*, 238*b* are shown in FIG. 19, and extend across the corners between adjacent skirts 230*a* and 230*c*, and adjacent skirts 230*a* and 230*d*, respectively. For example, bracket 238*a* may extend between front skirt 230*a* and side skirt 230*c* while bracket 238*b* extends between the front skirt and side skirt 230*d*. Similar brackets 238*c*, 238*d* (not shown) may also be provided in the opposite corners, near the back 220 of chair 204.

As shown in FIG. 19, an end user may simply lift the seat 222 off the brackets 238*a*, 238*b*, 238*c*, 238*d* to remove the seat 222 from the chair 204. No other mechanical installation devices, such as screws or bolts, need be provided. Rather, gravity and the weight of the seat 222, seat cushion 232, and the end user will hold the seat 222 in place. It is also noted with respect to FIG. 19 that the front skirt 230*a* remains in place even when the seat 222 is removed. In alternative embodiments, the front skirt 230*a* and seat 222 may be a single unit. Such feature is disclosed with respect to the sofa 202, shown in FIG. 20-26. In still further embodiments, installation devices, such as those listed above, may be utilized.

After the seat 222 is removed from chair 204, another piece of furniture may be placed in the resulting void within the chair's confines.

One aspect of the invention is to package individual pieces of furniture in a compact and efficient manner. Therefore, a piece of furniture may be placed within the confines of another piece of furniture such that there is minimal to no addition in total volume of the confine of the furniture assembly. For instance, end table 108, as depicted in FIG. 1, may fit within the confines of chair 204 without adding volume to the confines of the chair 204, which itself may subsequently fit within the confines of another article of the furniture assembly, namely the confines of the sofa.

Each of the component parts of chair 204 contribute to at least one of a height, width, and length dimension of the volume of the confine of chair 204. For example, the pair of front legs 224*a*, 224*b*, and rear legs 226*a*, 226*b*, may generally define the width and length of the confine. Further, a bottom surface of the pair of front legs 225*a*, 225*b*, and rear legs 227*a*, 227*b* to a top surface 229 of the back 220 of chair 204 may generally define the height of the confine.

FIGS. 20-26 depict a sofa 202, such as the sofa shown in FIGS. 4, 8, and 10-17. In these views, the seat 242 may be clearly seen. As previously addressed, the seat 242 and front skirt 250*a* of the sofa 202 may be integrally formed or otherwise connected, such that they form a single unit. The seat 242 and front skirt 250*a* may be arranged to be easily removable from the remainder of the sofa 202, such that they may be removed during storage or packing. In this regard, and in a similar manner to the chair 204 previously discussed, certain of the other skirts 250*b*, 250*c*, and 250*d*, may include brackets upon which the seat 222 may rest when installed. Specifically, the seat 242 may rest on two brackets 258*a*, 258*b* (not shown), one spanning between the rear skirt 250*b* and a side skirt 250*c*, and the other between the rear skirt and a second side skirt 250*d*.

Figure 25:
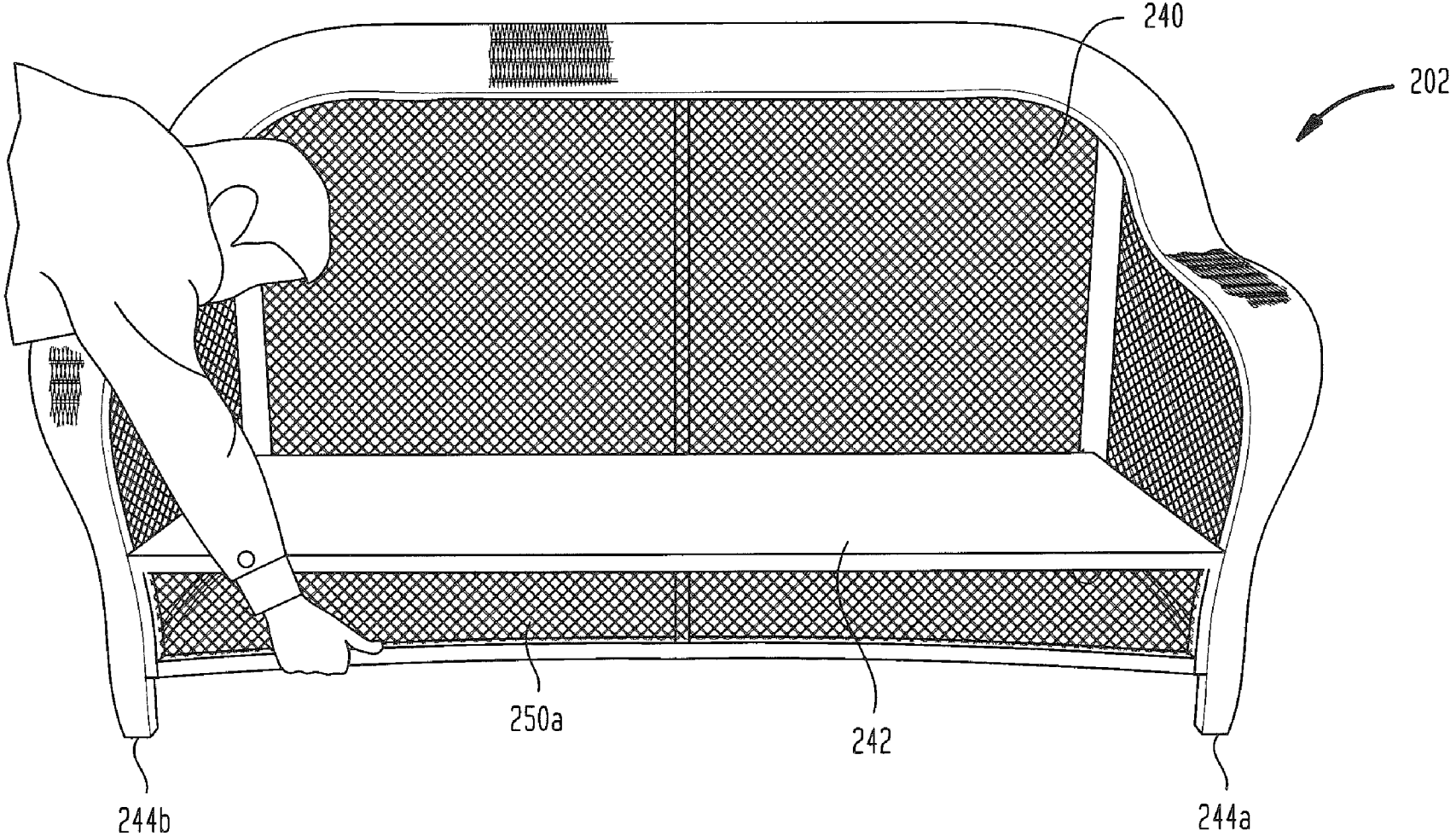
FIG. 25 depicts a further step in the method of disassembling the chair shown in FIGS. 10-17.
Figure 26:
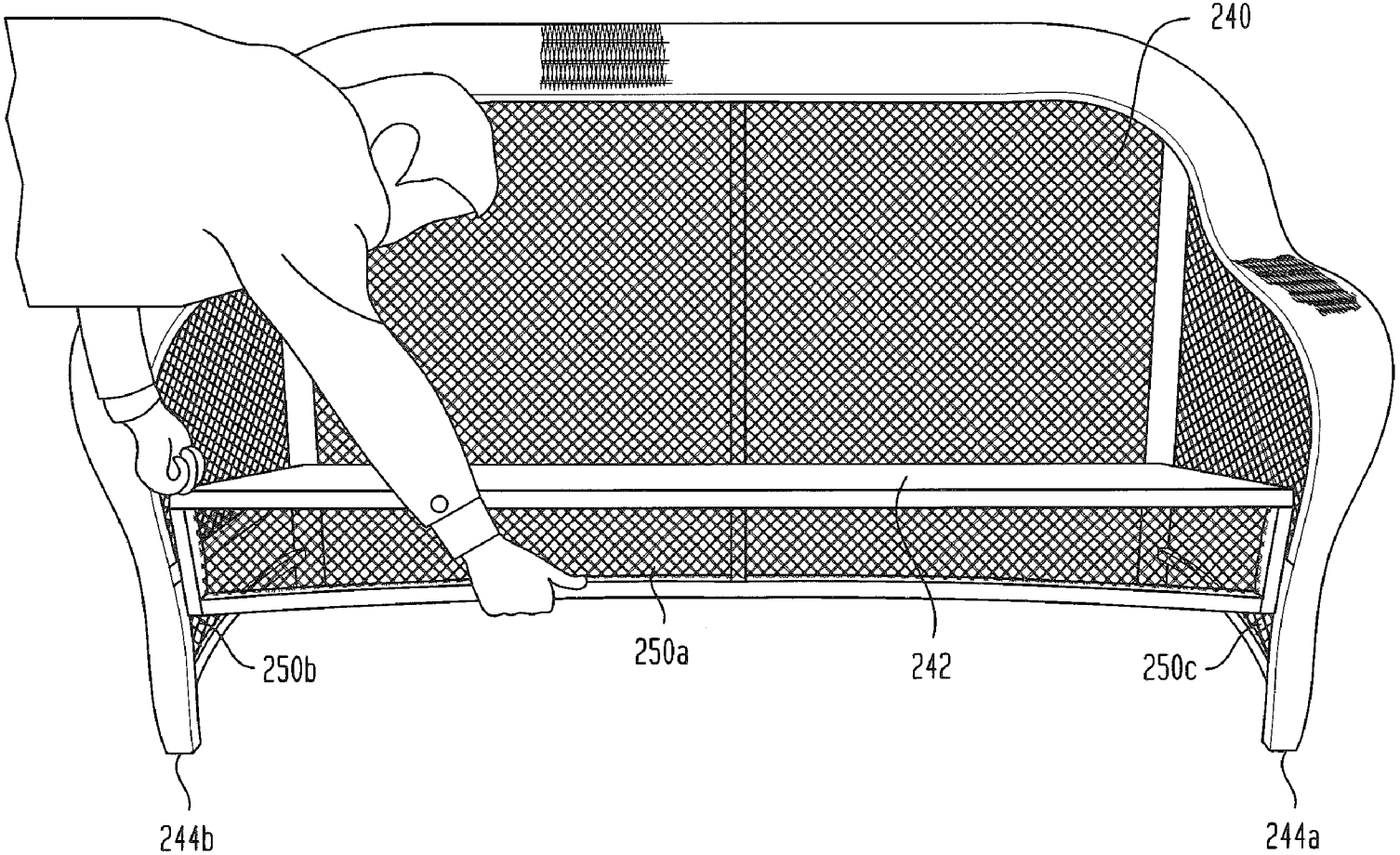
FIG. 26 depicts still another step in the method of disassembling the chair shown in FIGS. 10-17.

Front skirt 250*a* may be secured to the remainder of the sofa 202 by virtue of screws 260, bolts, or the like, extending through the front skirt 250*a* and into the front legs 244*a*, 244*b*. In this regard, FIGS. 21 and 22 each depict a screw 260 being unscrewed from leg 244*b* and FIGS. 23 and 24 each depict a screw being unscrewed from leg 244*a*, for a total of four screws securing the front skirt 250*a*. Once the screws 260 are completely removed, a user may lift the front portion of the front skirt 250*a* to remove both the front skirt and seat 242 from the remainder of the sofa 202, as shown in FIGS. 25 and 26. The legs 244*a*, 244*b* may be tapped or may include other features, such as receiving flanges, for receiving the screws 260. In other embodiments, the front skirt 250*a* and the seat 242 may be secured with more or less than four installation devices.

After the front skirt 250*a* and seat 242 are removed from sofa 204, another piece of furniture may be placed in the resulting void within the sofa's 204 confines.

An aspect of the invention is to package individual pieces of furniture in a compact and efficient manner. Therefore, a piece of furniture may be placed within the confines of another piece of furniture such that there is minimal to no addition in total volume of the confines of the furniture assembly. For instance, chair 204 as seen in FIG. 18 may generally fit within the confines of sofa 202 without adding substantial volume to the confines of sofa 202, which is configured to fit within the confines of the furniture assembly. For instance, the chair 204 may be inverted and arm 228*a* of chair 204 may rest on top of arm 248*a* of sofa 202. Additionally, chair 204 may extend slightly beyond the strict confines of sofa 202, but still be within the sofa confines as defined herein.

Each of the component parts of sofa 202 generally contribute to at least one of a height, width, and length dimension of the volume of the confines of sofa 202. For example, the pair of front legs 244*a*, 244*b*, and rear legs 246*a*, 246*b*, may generally define the width and length of the confines. Further, a bottom surface of the pair of front legs 245*a*, 245*b*, and rear legs 247*a*, 247*b* to a top surface 249 of the back 240 of sofa 202 may generally define the height of the confines.

Figure 27:
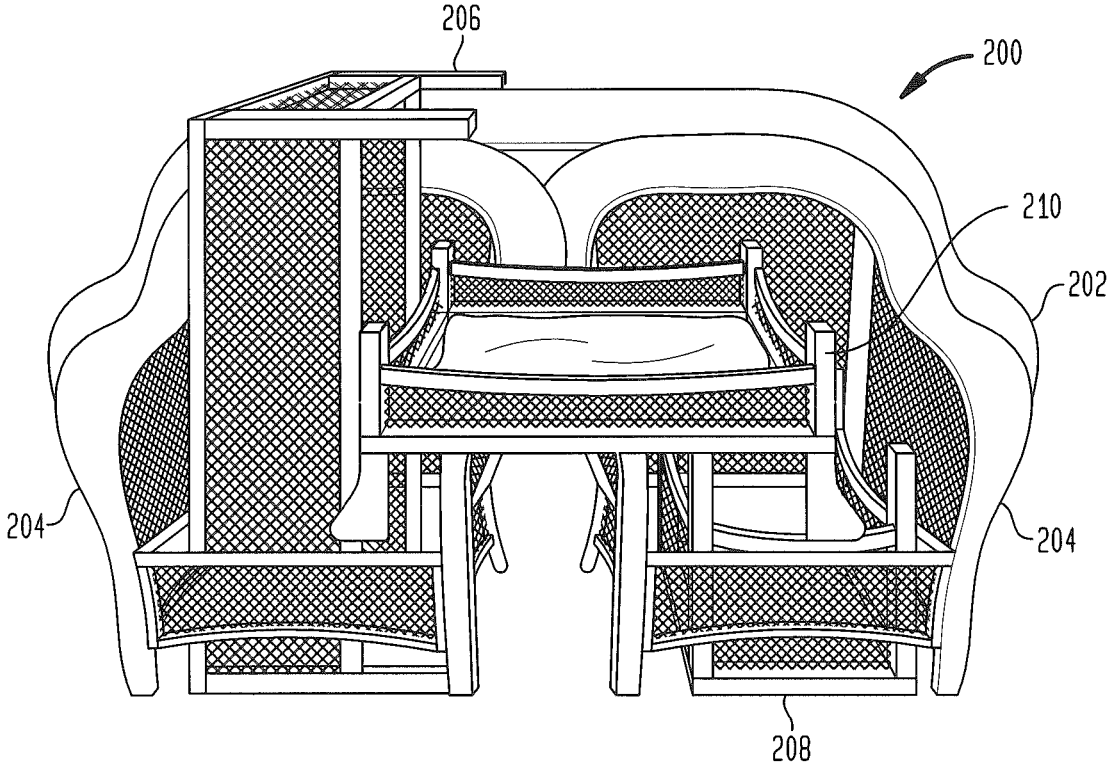
FIG. 27 depicts a frontal view of a furniture assembly packaged for compact shipping or storage in accordance with aspects of the present invention.
Figure 28:
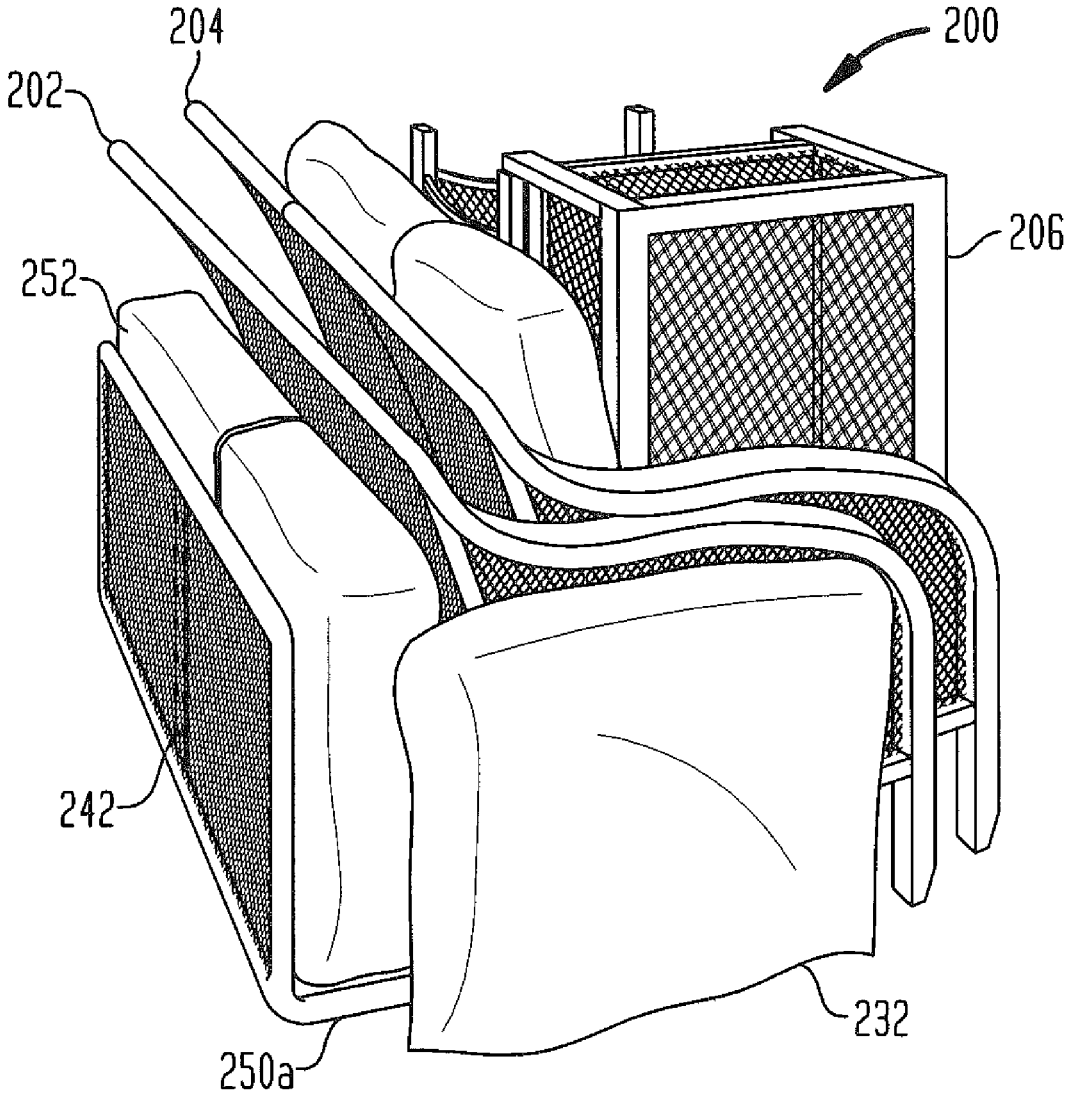
FIG. 28 depicts a side perspective view of the furniture assembly of FIG. 27.
Figure 29:
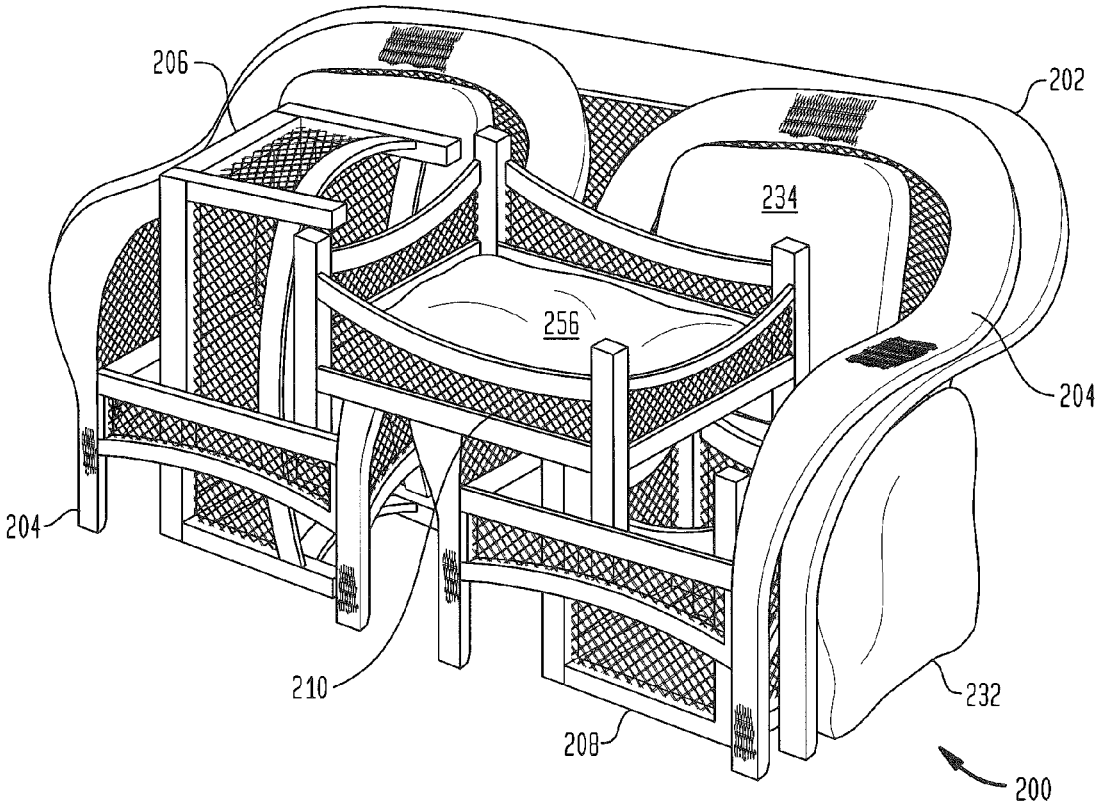
FIG. 29 depicts a three-quarter perspective view of the furniture assembly of FIG. 27.

In one embodiment of the present invention, once the front skirt 250*a* and seat 242 are removed from the sofa 202, and the seat 222 is removed from the chair 204 (or chairs, as the case may be), the pieces of furniture 200 may be placed substantially within the confines of sofa 202, as shown in FIGS. 27-29, such that the individual pieces may be packed with minimal voids. As shown most clearly in FIG. 29, it is to be understood that the width of the confines of sofa 202 is extended beyond the strict width of the sofa itself to permit portions of the chairs 204, including the arm 228*a* of a first chair 204 and the arm 228*b* of a second chair 204, to fit within the defined confines, as the term is used herein.

In one stacking arrangement, and simply as an example, a sofa 202 may be placed down first, the sofa positioned in its normal orientation with legs 244*a*, 244*b*, 246*a*, and 246*b* on the floor. First and second chairs 204 may then be placed side by side substantially within the confines of the sofa 202, as best shown in FIG. 29, with their respective backs 220 against the back 240 of the sofa. A coffee table 206 may then be placed substantially within the confines of the first chair 204 and an end-table 208 may then be placed within the confines a second chair 204, as best shown in FIG. 27. An ottoman 210 may then be placed upside-down substantially within the confine of each chair 204, mostly above the end-table 208, as shown most clearly in FIG. 27.

In addition, the seat cushions 252 of the sofa 202 may be placed against the outside of the back 240 of the sofa, with the seat 242 and front skirt 250*a* following thereafter, as shown most clearly in FIG. 28. It is to be understood that such placement of the seat cushions 252, seat 242, and front skirt 250*a* are considered within the confines of the sofa 202, as defined herein. The various other cushions 232, 234, 254, and pillows 256 may finally be placed within the remaining voids, to provide a compact and efficient package. Of course, other compact configurations may also be utilized, the configurations depending on the pieces included in the furniture assembly 200 and the degree of compactness required.

Figure 30:
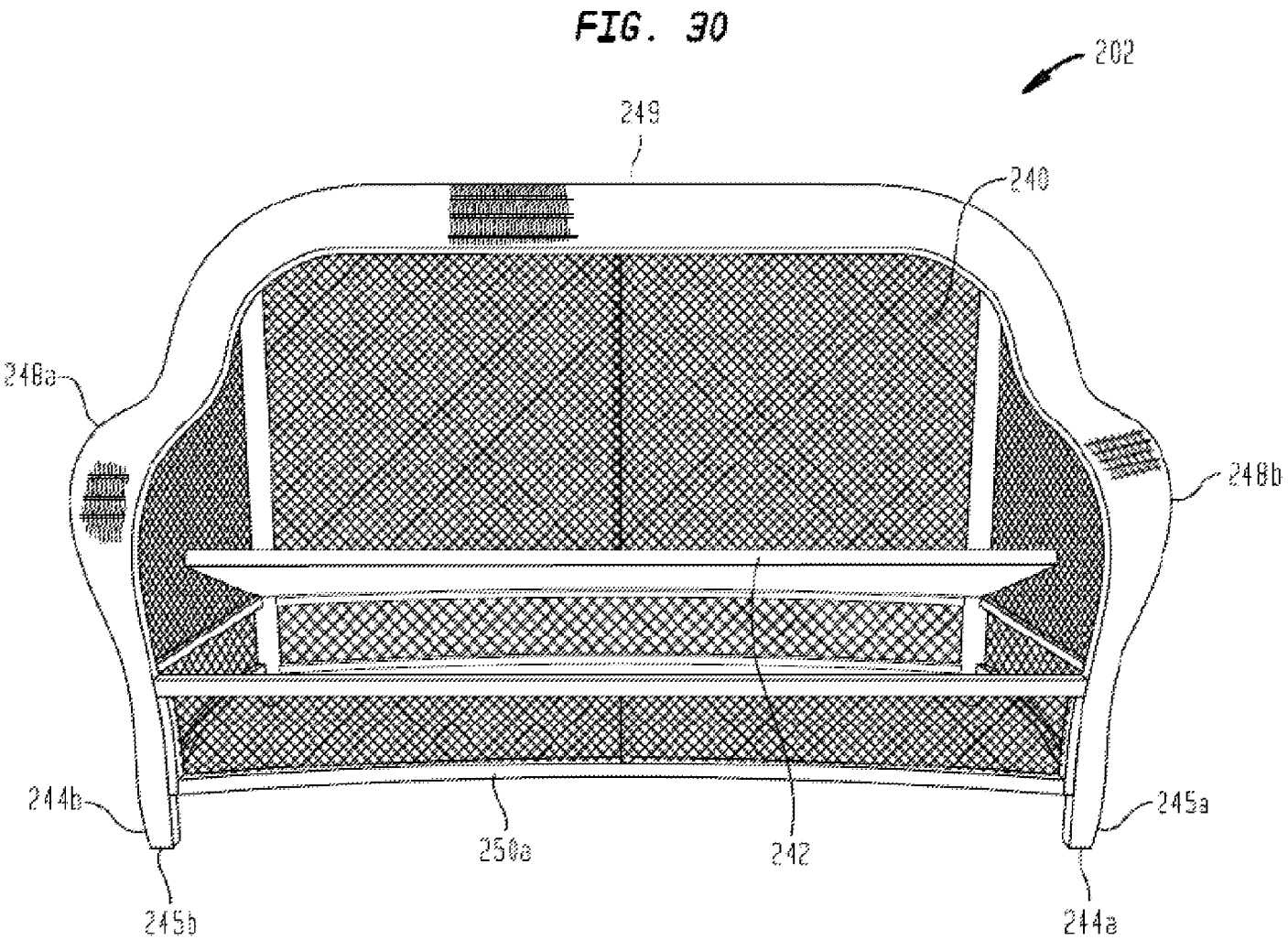
FIG. 30 depicts a sofa in accordance with certain aspects of the invention with the seat and front skirt detached from each other.

Lastly, FIG. 30 depicts a sofa 202 with the seat 242 and front skirt 250*a* detached from each other, in accordance with certain aspects of the invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A furniture assembly for compact and efficient packaging comprising:

a sofa having component parts connected to define a partially enclosed area, the component parts including a back, a pair of front legs, and a pair of rear legs, the sofa also comprising a seat and a skirt, wherein the skirt and the seat are detachable from each other and the skirt is detachable from the component parts;

at least one chair; and a table;

wherein the furniture assembly is arranged such that the at least one chair and the table are located within the partially enclosed area with the skirt and seat detached from each other and the skirt detached from the component parts.

2. The furniture assembly of claim 1, further comprising an ottoman, wherein the ottoman is located within the partially enclosed area.

3. The furniture assembly of claim 1, wherein the at least one chair is two chairs and the two chairs are placed side by side within the partially enclosed area.

4. The furniture assembly of claim 1, further comprising a plurality of cushions and pillows, wherein the plurality of cushions and pillows are located within the partially enclosed area.

5. The furniture assembly of claim 1, wherein said table is a coffee table.

6. The furniture assembly of claim 5, further comprising an end table, wherein the end table is located within the partially enclosed area.

7. The furniture assembly of claim 1, wherein the table is a coffee table, the furniture assembly further comprising an ottoman, an end table, and a plurality of cushions and pillows, wherein the coffee table, ottoman, end table, and plurality of cushions and pillows are located within the partially enclosed area.

8. The furniture assembly of claim 7, wherein at least one of the plurality of cushions is placed against the back of the sofa.

9. The furniture assembly of claim 8, wherein at least one of the plurality of cushions is placed against the side of the sofa between one of the pair of front legs and one of the pair of rear legs.

10. The furniture assembly of claim 7, wherein the sofa, the at least one chair, the coffee table, the end table, and the ottoman all include four skirts.

11. The furniture assembly of claim 1, wherein the sofa further comprises two arms.

12. The furniture assembly of claim 1, wherein the at least one chair further comprises two arms.

13. A furniture assembly comprising:

a sofa having component parts connected to define a partially enclosed area, the component parts including a back, a pair of front legs, and a pair of rear legs, the sofa also comprising a skirt and a seat, wherein the skirt and the seat are detachable from each other and the skirt is detachable from the component parts;

and at least one additional piece of furniture selected from the group consisting of at least one chair, a coffee table, an end table, and an ottoman;

wherein the skirt and seat of the sofa are detached from each other, the skirt is detached from the component parts, and the at least one additional piece of furniture is arranged within the partially enclosed area.

14. A method of furniture assembly from articles of furniture including a sofa having component parts connected to define a partially enclosed area, at least one chair, a table, and a plurality of cushions, the component parts of the sofa including a back, a pair of front legs, and a pair of rear legs, the sofa also comprising a skirt and a seat, wherein the skirt and the seat are detachable and the skirt is detachable from the component parts, the method of furniture assembly comprising the steps of:

detaching the seat from the skirt;

detaching the skirt from the component parts;

placing the sofa in a packaging location with the skirt and seat detached and the skirt detached from the component parts;

placing a first chair within the partially enclosed area;

placing the table within the partially enclosed area;

placing the skirt and seat within the partially enclosed area;

placing the plurality of cushions and pillows within the partially enclosed area.

15. The method of furniture assembly of claim 14, wherein the sofa further comprises two arms.

16. The method of furniture assembly of claim 15, wherein the first chair comprises two arms.

17. The method of furniture assembly of claim 16, wherein one arm of the first chair is placed over one arm of the sofa.

18. The method of furniture assembly of claim 14, further comprising placing a second chair within the partially enclosed area.

19. The method of furniture assembly of claim 14, wherein the skirt and the seat are detachable from each other and wherein the skirt and seat are detached from each other in the step of placing the sofa in a packaging location with the skirt and seat detached.

* * * * *